US012419479B2

(12) United States Patent
VanTongeren et al.

(10) Patent No.: US 12,419,479 B2
(45) Date of Patent: Sep. 23, 2025

(54) DOCKING STATION FOR AN AUTONOMOUS FLOOR CLEANER

(71) Applicant: BISSELL Inc., Grand Rapids, MI (US)

(72) Inventors: Todd R. VanTongeren, Ada, MI (US); Justin Nguyen, Wyoming, MI (US)

(73) Assignee: BISSELL Inc., Grand Rapids, MI (US)

( * ) Notice: Subject to any disclaimer, the term of this patent is extended or adjusted under 35 U.S.C. 154(b) by 350 days.

(21) Appl. No.: 18/077,300

(22) Filed: Dec. 8, 2022

(65) Prior Publication Data

US 2023/0190062 A1 Jun. 22, 2023

Related U.S. Application Data

(60) Provisional application No. 63/290,809, filed on Dec. 17, 2021.

(51) Int. Cl.
*A47L 9/28* (2006.01)

(52) U.S. Cl.
CPC ..... *A47L 9/2873* (2013.01); *A47L 2201/022* (2013.01); *A47L 2201/026* (2013.01); *A47L 2201/028* (2013.01)

(58) Field of Classification Search
CPC ..... A47L 9/2873; A47L 9/2201; A47L 9/00; A47L 9/02; A47L 9/024; A47L 9/026; A47L 9/028; A47L 11/24
See application file for complete search history.

(56) References Cited

U.S. PATENT DOCUMENTS

| | | | | |
|---|---|---|---|---|
| 5,959,423 | A | 9/1999 | Nakanishi et al. | |
| 2009/0044370 | A1* | 2/2009 | Won | A47L 11/4013 15/319 |

FOREIGN PATENT DOCUMENTS

| | | | |
|---|---|---|---|
| DE | 102010017211 | A1 | 12/2011 |
| DE | 102020119345 | A1 | 1/2022 |
| EP | 3366180 | A1 | 12/2017 |
| KR | 20210004506 | A * | 1/2021 |
| WO | 2022194373 | A1 | 9/2022 |

* cited by examiner

*Primary Examiner* — C. A. Rivera
(74) *Attorney, Agent, or Firm* — Warner Norcross + Judd LLP

(57) ABSTRACT

A docking station for an autonomous floor cleaner performs maintenance on the autonomous floor cleaner, including removing a mopping implement from the autonomous floor cleaner and/or installing a mopping implement on the autonomous floor cleaner. The docking station can further perform other maintenance services on the autonomous floor cleaner. An autonomous floor cleaning system including an autonomous floor cleaner and a docking station is also disclosed. Methods for servicing or performing maintenance on an autonomous floor cleaner by a docking station are also disclosed.

20 Claims, 12 Drawing Sheets

DOCKING STATION FOR AN AUTONOMOUS FLOOR CLEANER

CROSS-REFERENCE TO RELATED APPLICATION(S)

The present application claims the benefit of U.S. Provisional Patent Application No. 63/290,809, filed Dec. 17, 2021, which is incorporated herein by reference in its entirety.

BACKGROUND

Autonomous or robotic floor cleaners can move without the assistance of a user or operator to clean a floor. For example, the floor cleaner can be configured to vacuum or sweep debris (including dust, hair, and other debris) into a collection bin carried on the floor cleaner. Some floor cleaners are configured to apply liquid for wet cleaning of bare floors, carpets, rugs, and other floor surfaces, and often include one or more mopping implements that absorb liquid and debris. Still other floor cleaners are configured to extract liquid from the floor.

Autonomous floor cleaners can move randomly about a floor while cleaning or use a mapping/navigation system for guided navigation about the floor. Many autonomous floor cleaners need to return to a docking station to recharge their battery. In order to further autonomize the cleaning process, some docking stations have been adapted to empty the collection bin so that intervention/servicing by a human is not required. However, since autonomous floor cleaners adapted for wet cleaning, i.e. robots that apply and/or extract liquid, typically need at least one mopping implement that becomes wet and dirty during use, frequent intervention/servicing by a human user to clean the mopping implement is still necessary for wet cleaning robots. Often, the human user must remove the mopping implement from the robot, wash it, dry it, and return it to the robot after each cleaning operation, which is time-consuming and requires an amount of unpleasant effort that defeats the purpose of an autonomous cleaner.

Therefore, there still exists a need for an automatous cleaning system that reduces the frequency of intervention and servicing by a human user.

BRIEF SUMMARY

The disclosure relates to a docking station for an autonomous floor cleaner. Various methods for servicing an autonomous floor cleaner by a docking station are described herein.

In one aspect of the disclosure, an autonomous floor cleaning system includes an autonomous floor cleaner having an autonomously moveable housing, a drive system operable to move the autonomously moveable housing about a floor surface, and a cleaning pad on an underside of the autonomously moveable housing, and a docking station having a base and a platform configured to underlie the cleaning pad in a docked position of the autonomous floor cleaner at the docking station, the platform moveable upwardly in a direction away from the base and downwardly in a direction toward the base.

In another aspect of the disclosure, a method for servicing an autonomous floor cleaner at a docking station is provided and includes docking the autonomous floor cleaner at the docking station responsive to a return-to-dock event, raising a platform of the docking station beneath a cleaning pad on the autonomous floor cleaner, scrubbing the cleaning pad against the platform, removing a cleaning pad from the autonomous floor cleaner at the docking station, and lowering the platform of the docking station.

In yet another aspect of the disclosure, a docking station for an autonomous floor cleaner includes a housing comprising a base, at least one charging contact, and a platform moveable upwardly in a direction away from the base and downwardly in a direction toward the base, wherein the platform comprises a lowered position for the autonomous floor cleaner to dock at the docking station and a raised position to engage a cleaning pad on the autonomous floor cleaner.

In still another aspect, a docking station for an autonomous floor cleaner includes a mechanism for removing a mopping implement from the autonomous floor cleaner and/or a mechanism for installing a mopping implement on the autonomous floor cleaner.

In a further aspect, the docking station can include one or more of the following: a mechanism for cleaning the mopping implement, a space for storing the autonomous floor cleaner, charging contacts, a supply tank refilling mechanism, a collection bin emptying mechanism, an expanded physical user interface, an accessory storage space, edge brush cleaning, cleaning fluid heating, or any combination thereof.

In yet a further aspect, a method for servicing an autonomous floor cleaner at a docking station includes removing a mopping implement from the autonomous floor cleaner at the docking station. Optionally, the mopping implement can be cleaned at the docking station prior to or after removal of the mopping implement from the autonomous floor cleaner.

In still a further aspect, a method for docking an autonomous floor cleaner with a docking station includes installing a mopping implement on the autonomous floor cleaner at the docking station. Optionally, the mopping implement can be cleaned at the docking station prior to or after installation of the mopping implement on the autonomous floor cleaner.

These and other features and advantages of the present disclosure will become apparent from the following description of particular embodiments, when viewed in accordance with the accompanying drawings and appended claims.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

DETAILED DESCRIPTION

The disclosure generally relates to the docking of autonomous floor cleaners with docking stations. More specifically, the disclosure relates to docking stations for wet cleaning robots and the servicing of wet cleaning robots.

Figure 1:
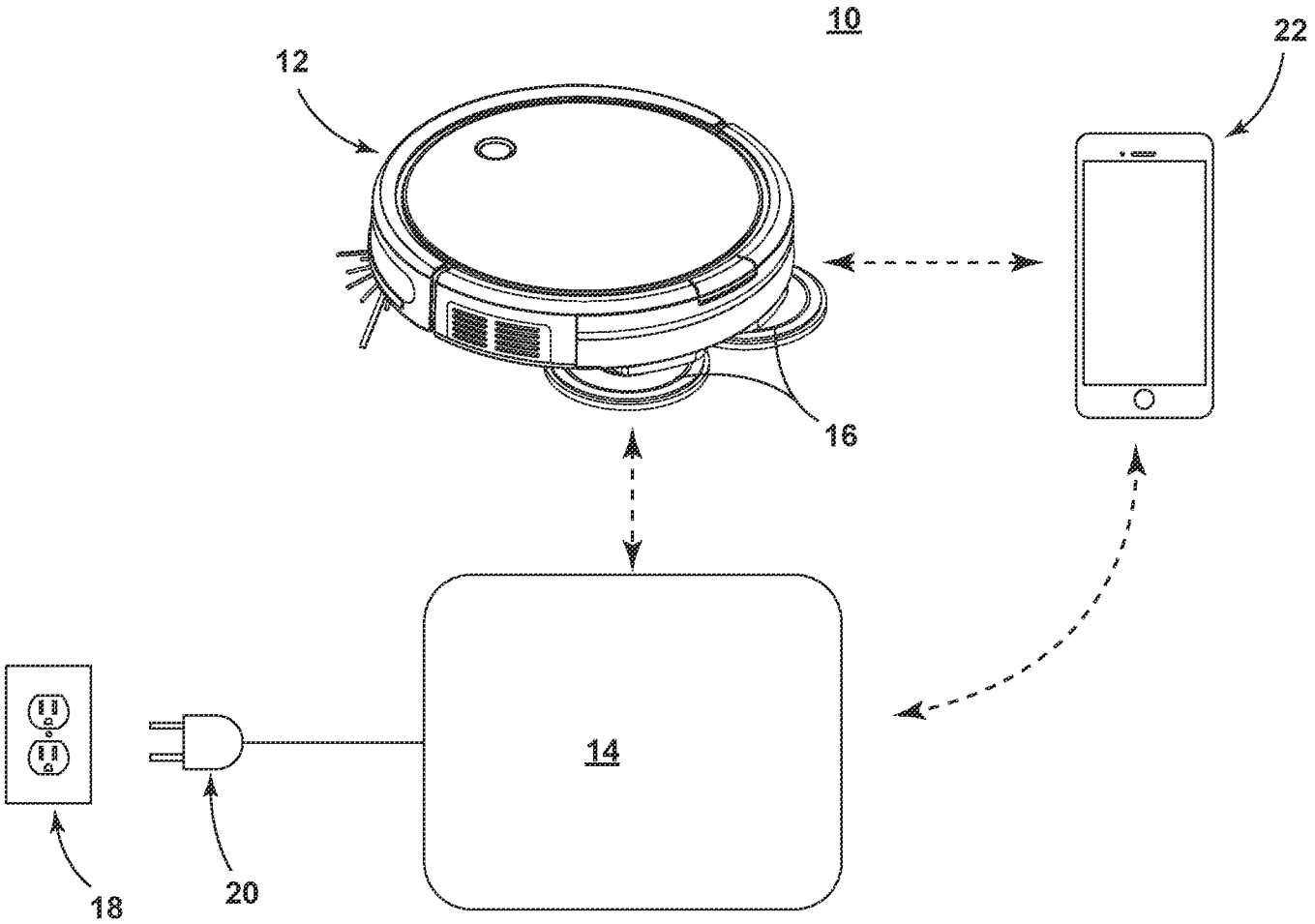
FIG. 1 is a perspective view of an autonomous floor cleaning system according to one aspect of the disclosure, the system including at least an autonomous floor cleaner, or robot, and a docking station.

FIG. 1 is a schematic view of an autonomous floor cleaning system 10 according to one embodiment of the invention. The autonomous floor cleaning system 10 includes an autonomous floor cleaner 12 and a docking station 14 for the autonomous floor cleaner 12, also referred to herein as a robot. The robot 12 can clean various floor surfaces, including bare floors such as hardwood, tile, and stone, and soft surfaces such as carpets and rugs. Optionally, the system 10 can include an artificial barrier system (not shown) for containing the robot 12 within a user-determined boundary.

The robot 12 is dockable with the docking station 14 for recharging of the robot 12. Additionally, the robot 12 is dockable with the docking station 14 for servicing of the robot 12, e.g. performing maintenance, in tandem with or separately from recharging the robot 12, thereby greatly extending the time between interventions by a human user.

The robot 12 includes at least one mopping implement 16 that becomes wet and dirty during a cleaning operation. The robot 12 can be docked with the docking station 14, and the docking station 14 can automatically remove the mopping implement 16. Removal of the mopping implement 16 may also be performed when switching from wet cleaning to dry cleaning. The docking station 14 can store the removed mopping implement 16 after the robot 12 leaves the docking station 14.

In some embodiments, the docking station 14 can automatically install the mopping implement 16 on the robot 12. Installation of the mopping implement 16 may be performed when switching from dry cleaning to wet cleaning.

In one example, if the robot 12 is to perform dry cleaning and the mopping implement 16 is present on the robot 12, the robot 12 can dock at the docking station 14 for removal of the mopping implement 16. If the robot 12 is to perform wet cleaning and the mopping implement 16 is not present on the robot 12, the robot 12 can dock at the docking station 14 for installation of the mopping implement 16.

Some non-limiting examples of other service functions that the docking station 14 can perform on the robot 12 include robot storage, robot charging, mopping implement cleaning, supply tank refill, collection bin emptying, expanded user control, accessory storage, edge brush cleaning, and/or cleaning fluid heating. Accordingly, the docking station 14 can include one or more of the following: a mechanism for cleaning the mopping implement 16, a space for storing the autonomous floor cleaner 12, charging contacts, a supply tank refilling mechanism, a collection bin emptying mechanism, an expanded physical user interface, an accessory storage space, edge brush cleaning, cleaning fluid heating, or any combination thereof.

In some embodiments, the robot 12 includes a mechanism for cleaning the mopping implement 16. The mopping implement 16 can be cleaned at the docking station 14 prior to removal of the mopping implement 16 from the autonomous floor cleaner 12. The mopping implement 16 can be stored by the docking station 14 after removal from the robot 12.

The docking station 14 can be connected to a household power supply, such as an A/C power outlet 18, and can include a converter 20 for converting the AC voltage into DC voltage for recharging the power supply on-board the robot 12. The docking station 14 can also include various sensors and emitters (not shown) for monitoring robot status, enabling auto-docking functionality, communicating with the robot 12, as well as features for network and/or Bluetooth connectivity.

The system 10 may include a personal communication device 22 in communication with the robot 12 and/or the docking station 14. The personal communication device 22 can include, but is not limited to, a mobile communication device such as a smart phone or tablet, a personal computer such as a laptop, or a voice-controlled remote device such as an Amazon Echo® or Amazon Echo Dot® having the Amazon Alexa® cloud-based voice service, or a Google Home® or Google Home Mini® having Google Assistant. For example, a user with a smart speaker device can speak an instruction, such as "Alexa, ask [robot] to start cleaning," and via the Wi-Fi and/or Internet connectivity, the robot 12 can begin a cleaning cycle of operation. Other spoken commands can include, but are not limited to, instructing the robot 12 to return to the docking station and instructing the robot 12 to switch from dry cleaning to wet cleaning or vice versa, and via the Wi-Fi and/or Internet connectivity, the robot 12 can execute the spoken command. As another example, a user speak commands to the docking station 14, including, but not limited to, instructing the docking station 14 to remove the mopping implement 16 from the robot 12, instructing the docking station 14 to install the mopping implement 16 on the robot 12, and instructing the docking station 14 to clean the mopping implement 16, and via the Wi-Fi and/or Internet connectivity, the docking station 14 can execute the spoken command.

A smart device application for the robot 12 and/or docking station 14 that is executed on the personal communication device 22 can include command and control features including, but not limited to, scheduling features to enable a user to select when the robot 12 will conduct cleaning. Other features of the smart device application can include a display of the robot's cleaning history, a landing page with current blogs and support videos related to the robot 12, and controls to automatically reorder accessories for the robot 12 when needed. The smart device application can also be configured to provide detailed notifications relating diagnostics, error warnings, and other information directly to the user.

In one example, via the smart device application, the user can instruct the robot 12 to return to the docking station 14, instruct the docking station 14 to remove the mopping implement 16 from the robot 12, instruct the docking station 14 to install the mopping implement 16 on the robot 12, or any combination thereof. In another example, via the smart device application, the user can instruct the robot 12 to perform wet cleaning or dry cleaning. Upon an instruction to perform wet cleaning, if the mopping implement 16 is not present on the robot 12, the robot 12 can dock at the docking station 14 for installation of the mopping implement 16. Upon an instruction to perform dry cleaning, if the mopping implement 16 is present on the robot 12, the robot 12 can dock at the docking station 14 for removal of the mopping implement 16.

The robot 12 can include various systems, and components, and may at least include a mopping system including the mopping pads 44 and a fluid delivery system that stores a cleaning fluid on board the robot 12 and dispenses the cleaning fluid during a cleaning operation, e.g. by dispensing cleaning fluid on the mopping implement 16 and/or on surface to be cleaned. The cleaning fluid may be dispensed as a liquid, steam, mist, vapor, or mixture thereof. In one embodiment, and as will be described in further detail below, the robot 12 is a wet mopping and sweeping robot including a fluid delivery system a mopping system, and a sweeping system for collecting cleaning fluid and debris from the surface to be cleaned without the use of suction. In another embodiment, the robot 12 can be a wet mopping robot including a fluid delivery system and a mopping system, without any sweeping system. In yet another embodiment, the robot 12 can be a deep cleaning robot including a fluid delivery system, a mopping system, and a recovery system for removing liquid and/or debris from the surface to be cleaned and storing the recovered cleaning liquid and/or debris on board the robot 12. The recovery system can include a suction source for creating a partial vacuum to suck up liquid and/or debris from the surface. In still another embodiment, the robot 12 can be a wet/dry cleaning robot including a fluid delivery system, a mopping system, and a vacuum system for removing substantially "dry" debris (e.g., not liquid or heavily saturated debris) from the surface to be cleaned and storing the debris on board the robot 12. The vacuum system can include a suction source for creating a partial vacuum to suck up debris from the surface. The docking station 14 can be configured to dock, recharge, and service any of the aforementioned robot types.

As used herein, the term "debris" includes dirt, dust, soil, hair, and other debris, unless otherwise noted.

As used herein, the term "cleaning fluid" as used herein primarily encompasses liquids, and may include steam unless otherwise noted. Such liquids may include, but are not limited to, water or solutions containing water (like water mixed with a cleaning chemistry, fragrance, etc.).

Figure 2:
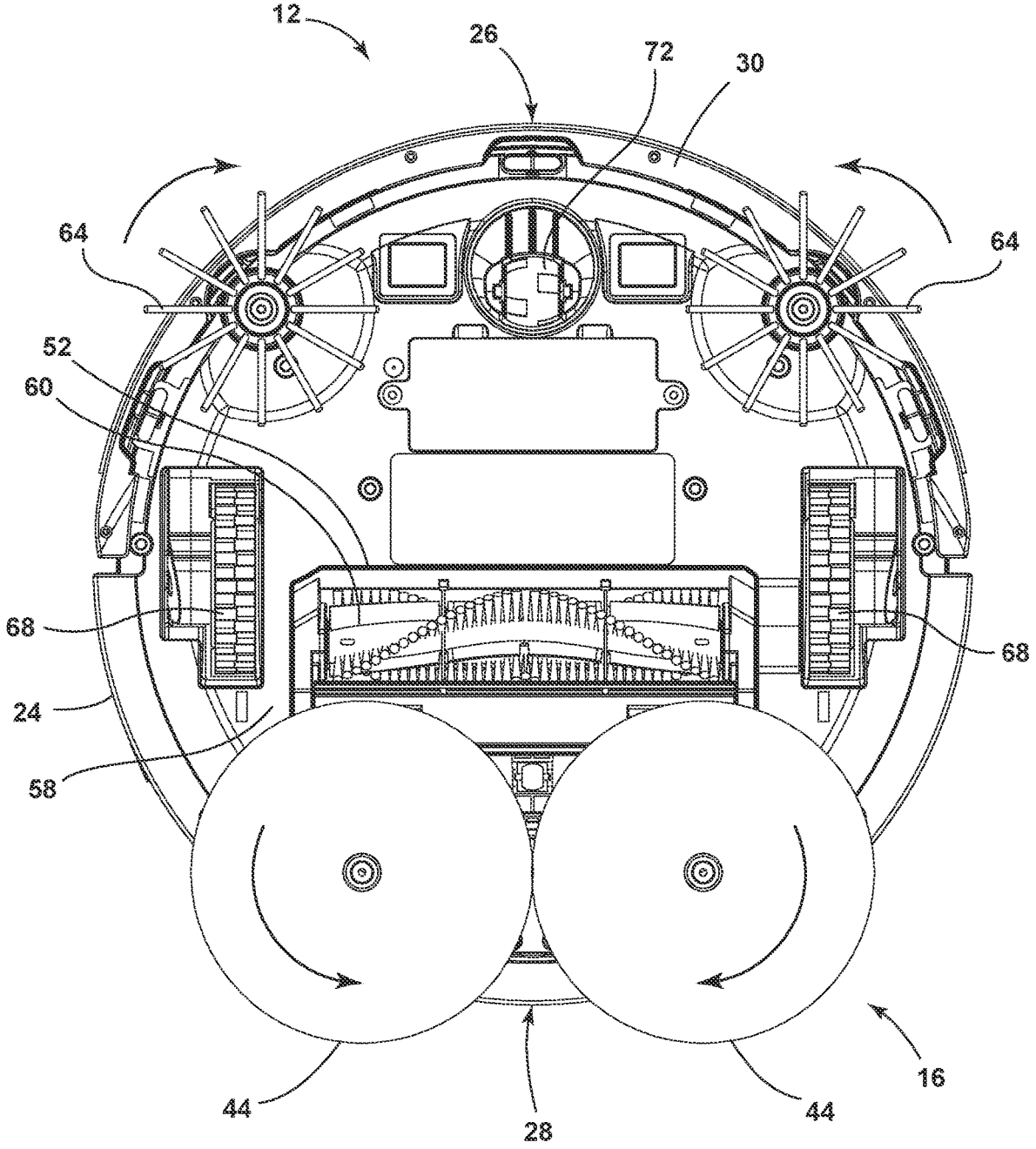
FIG. 2 is a bottom view of the robot from FIG. 1.
Figure 3:
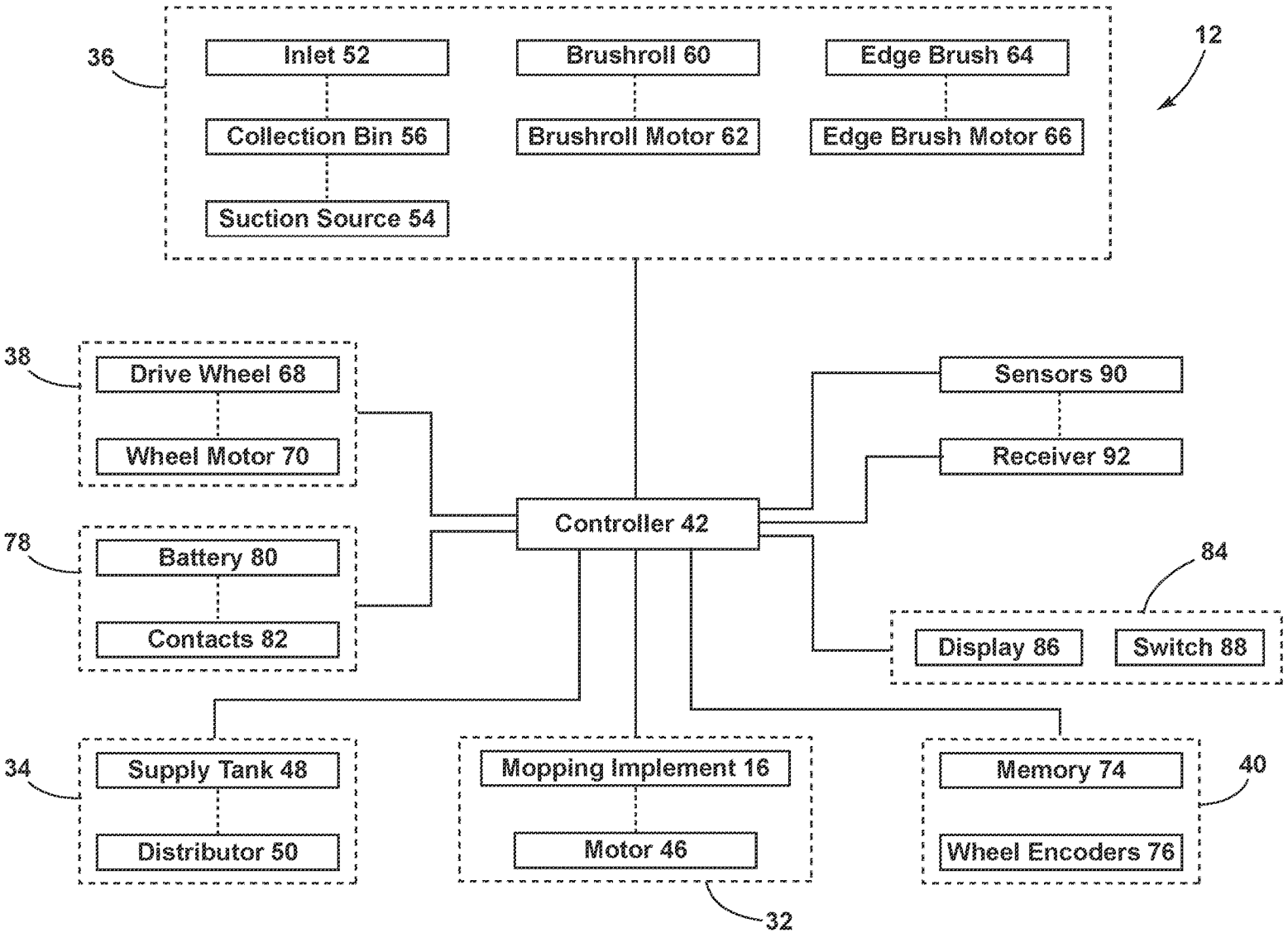
FIG. 3 is a schematic view of the robot from FIG. 1.

FIGS. 1-3 illustrate one embodiment of the robot 12 for the system 10. It is noted that the robot 12 shown is but one example of an autonomous floor cleaner that is usable with the system 10 and with the docking station 14, and that other autonomous floor cleaners can be used with the system 10 and docking station 14.

Referring to FIG. 2, the robot 12 mounts the components of various functional systems of the autonomous floor cleaner in an autonomously moveable unit or housing 24. The housing 24 of the robot 12 can be a circular, with a first end 26 and a second end 28. The first end 26 defines the front of the robot 12 and can optionally comprise a bumper 30. The second end 28 can define the rear of the robot 12 and the cleaning implement 16, which is a pair of mopping pads in the embodiment shown, can be disposed closer to the second end 28 of the robot 12 than the first end 26. Other shapes and configurations for the robot 12 are possible, including a D-shaped housing, configurations where the cleaning implement 16 is disposed closer to the first end 26 than the second end 28, or configurations where the cleaning implement 16 is disposed in the middle of the robot 12 between the first end 26 and the second end 28.

Referring to FIG. 3, the robot 12 includes a mopping system 32, a fluid delivery system 34, a vacuuming system 36, a drive system 38, and a navigation/mapping system 40. A controller 42 is operably coupled with the various functional systems 32-40 of the robot 12 for controlling the operation of the robot 12. The controller 42 can be a microcontroller unit (MCU) that contains at least one central processing unit (CPU).

In the embodiment shown, the mopping system 32 includes a mopping implement 16 comprising two mopping pads 44. The mopping pads 44 can comprise one or more different cleaning elements configured to mop the surface to be cleaned. Some non-limiting examples of cleaning elements for the mopping pads 44 comprise a microfiber pad or a wet scrubbing pad. The mopping pads 44 can be disposable or reusable. The pads 44 can be a circular, with a single side edge. Other shapes and configurations for the pads 44 are possible, including a shape having more than one side edge (e.g., non-circular). Other cleaning implements or cleaning pads are possible, including cleaning pads using for dusting, mopping, or other cleaning operations.

The mopping pads 44 can work by absorbing water, debris, and organic matter into the fibers of the cleaning elements. The pads 44 therefore are helpful when wet cleaning but become wet and dirty during use. For dry vacuuming, particularly on soft surfaces like carpet and area rugs, the pads 44 are not necessary and may transfer liquid and dirt back onto the soft surface. The pads 44 also generate friction with soft surfaces, depleting battery life of the robot 12. To automate removal and installation of pads 44, the docking station 14 can automatically remove and install the mopping pads 44, as described in further detail below. To prolong the useful life of the pads 44, the docking station 14 can wash the pads 44, as described in further detail below.

A drive assembly including at least one motor 46 can be provided to drive the mopping implement 16. In the embodiment shown with multiple mopping pads 44, the mopping pads 44 can be operated by a common motor 46 or individual motors 46. The pad motor 46 is configured to drive the mopping pads 44 about a substantially vertical rotational axis, relative to the surface to be cleaned. The direction of rotation for each mopping pad 44 is indicated in FIG. 2 by arrows. As is illustrated in FIG. 2, the mopping pads 44 can counter-rotate to balance the forces the pads 44 apply to the robot 12 so that the robot 12 can easily drive in a straight line. In one example, the mopping pads 44 extend beyond a periphery of the housing 24 to increase the mopping area coverage provided by the two pads 44.

The fluid delivery system 34 can include a supply tank 48 for storing a supply of cleaning fluid and at least one fluid distributor 50 in fluid communication with the supply tank 48. The fluid distributor 50 can deposit cleaning fluid onto the mopping pads 44, and soaks through the floor-facing lower surface of the mopping pads 44 for application onto the floor surface by the mopping pads 44. In other embodiments, the fluid distributor 50 can deposit cleaning fluid directly onto the surface. The cleaning fluid can be a liquid such as water or a cleaning solution specifically formulated for hard or soft surface cleaning. The fluid delivery system 34 can include appropriate flow control components to control the application of cleaning fluid by the fluid distributor 50. Such flow control components may include a pump, valves, conduits, tubing, and the like. In the embodiment shown, the fluid distributor 50 can comprise a drip bar. Alternatively, the fluid distributor 50 can be one or more spray nozzles or a manifold having multiple distributor outlets.

Various combinations of optional components can also be incorporated into the fluid delivery system 34, such as a heater (not shown). The heater can be configured, for example, to warm up the cleaning fluid before it is applied to the surface. In one embodiment, the heater can be an in-line fluid heater between the supply tank 48 and the distributor 50. In another example, the heater can be a steam generating assembly. The steam generating assembly is in fluid communication with the supply tank 48 such that some or all the liquid applied to mopping pads 44 or to the floor surface is heated to vapor.

The vacuuming system 36 can include a working air path through the unit having an air inlet and an air outlet, a suction inlet 52, a suction source 54 in fluid communication with the suction inlet 52 for generating a working air stream, and a collection bin 56 for collecting dirt and/or liquid from the working airstream for later disposal. The suction inlet 52 can define the air inlet of the working air path, with the inlet opening of the suction inlet 52 provided on an underside 58 (FIG. 2) of the housing 24 and facing a surface to be cleaned. The suction source 54 can include a vacuum motor carried by the housing 24, fluidly upstream of the air outlet (not shown), and can define a portion of the working air path. The collection bin 56 can also define a portion of the working air path, and comprise a dirt bin inlet (not shown) in fluid communication with the suction inlet 52. Optionally, a separator (not shown) can be formed in a portion of collection bin 56 for separating fluid and entrained dirt from the working airstream. Some non-limiting examples of separators include a cyclone separator, a filter screen, a foam filter, a HEPA filter, a filter bag, or combinations thereof. Optionally, a pre-motor filter and/or a post-motor filter (not shown) can be provided in the working air path as well. The working air path can further include various conduits, ducts, or tubes for fluid communication between the various components of the vacuuming system 36. The suction source 54 can be positioned fluidly downstream or fluidly upstream of the collection bin 56 in the working air path.

The vacuuming system 36 can also include at least one agitator for agitating the surface to be cleaned. The agitator can be in the form of a brushroll 60 mounted for rotation about a substantially horizontal axis, relative to the surface over which the robot 12 moves. A drive assembly including a brush motor 62 can be provided within the robot 12 to drive the brushroll 60. Other agitators or brushrolls can also be provided, including one or more stationary or non-moving brushes, or one or more brushes that rotate about a substantially vertical axis.

The suction inlet 52 can be positioned in close proximity to the brushroll 60 to collect debris directly from the brushroll 60. In other embodiments, the suction inlet 52 can be positioned to confront the surface to be cleaned to remove debris from the surface, rather than the brushroll 60.

Optionally, the robot 12 includes at least one edge brush 64 that can clean hard-to reach spaces such as along edges and in corners of a room, including edges or corners created by walls, baseboards, cabinetry, furniture, etc. The edge brush 64 can sweep debris under the housing 24 and toward the suction inlet 52. The edge brush 64 can comprise one or more different cleaning elements configured to brush, sweep, dust, mop, or otherwise move debris on the surface to be cleaned. Some non-limiting examples of cleaning elements for the edge cleaning brush comprise blades, bristles, paddles, blades, flaps, microfiber material, fabric, dusting pads, and the like.

Referring to FIG. 2, the robot 12 shown includes two edge brushes 64 on the underside 58 of the housing 24. The edge brushes 64 are arranged at opposite lateral sides, i.e. left and right sides, of the housing 24 so that the robot 12 can edge clean on either side of the housing 24 without changing the orientation of the housing 24. In other embodiments, only one edge brush 64 may be provided.

Referring to FIG. 3, a drive assembly including an edge brush motor 66 can be provided within the robot 12 to drive the edge brush 64. The brush motor 66 is configured to drive at least a portion of the edge brush 64 about a substantially vertical rotational axis, relative to the surface to be cleaned. Each edge brush 64 can include its own individual motor 66, or a single motor 66 can drive both brushes 64.

In another embodiment, the collection system can be configured as a sweeping system that removes dry debris from the floor surface without the use of suction. In this case, the suction source 54 may not be provided.

The drive system 38 can include drive wheels 68 for driving the robot 12 across a surface to be cleaned. The drive wheels 68 can be operated by a common wheel motor 70 or individual wheel motors 70 coupled with the drive wheels 68 by a transmission, which may include a gear train assembly or another suitable transmission. The drive system 38 can receive inputs from the controller 42 for driving the robot 12 across a floor, based on inputs from the navigation/mapping system 40 for the autonomous mode of operation or based on inputs from a smartphone, tablet, or other remote device for an optional manual mode of operation. The drive wheels 68 can be driven in a forward or reverse direction to move the unit forwardly or rearwardly. Furthermore, the drive wheels 68 can be operated simultaneously at the same rotational speed for linear motion or independently at different rotational speeds to turn the robot 12 in a desired direction.

While the drive system 38 is shown herein as including rotating wheels 68, it is understood that the drive system 38 can comprise alternative traction devices for moving the robot 12 across a surface to be cleaned. In addition to the drive wheels 68 or other traction devices, the robot 12 can include one or more additional wheels that support the housing 24, such as a castor wheel 72 at a center, rear portion of the underside 58 of the housing 24, as shown in FIG. 2.

The controller 42 can receive input from the navigation/mapping system 40 or from a remote device (e.g., the docking station 14 or the personal communication device 22 of FIG. 1) for directing the robot 12 over the surface to be cleaned. The navigation/mapping system 40 can include a memory 74 that can store any data useful for navigation, mapping or conducting a cycle of operation, including, but not limited to, maps for navigation, inputs from various sensors that are used to guide the movement of the robot 12, etc. For example, wheel encoders 76 can be placed on the drive shafts of the drive wheels 68 and configured to measure a distance traveled by the robot 12. The distance measurement can be provided as input to the controller 42.

In an autonomous mode of operation, the robot 12 can be configured to travel in any pattern useful for cleaning or sanitizing including boustrophedon or alternating rows (that is, the robot 12 travels from right-to-left and left-to-right on alternate rows), spiral trajectories, etc., while cleaning the floor surface, using input from various sensors to change direction or adjust its course as needed to avoid obstacles. In the optional manual mode of operation, movement of the robot 12 can be controlled using the personal communication device 22 (FIG. 1).

The robot 12 can include any number of motors useful for performing locomotion and cleaning and any number of motor drivers for controlling the motors. For example, motor drivers can be provided for controlling the mopping motor 46, suction source 54, brushroll motor 62, edge brush motor 66, and wheel motor 70, and, respectively. The motor drivers can act as an interface between the controller 42 and their respective motors. It is also contemplated that, in some cases, a single motor driver can control multiple motors simultaneously. For example, a single motor driver can control multiple pad motors 46.

The motors can be electrically coupled to a battery management system 78 that includes a rechargeable battery 80, which may comprise battery pack. Electrical contacts or charging contacts 82 for the battery 80 can be provided on an exterior surface of the robot 12. In one embodiment, the charging contacts 82 are provided on the underside 58 of the robot 12. In another embodiment, the charging contacts 82 are provided on a side of the housing 24.

The controller 42 is further operably coupled with a user interface (UI) 84 on the robot 12 for receiving inputs from a user. The UI 84 can be used to select an operation cycle for the robot 12 or otherwise control the operation of the robot 12. The UI 84 can have a display 86, such as an LED display, for providing visual notifications to the user. The robot 12 can be provided with a speaker (not shown) for providing audible notifications to the user. The UI 84 can further have one or more switches 88 that are actuated by the user to provide input to the controller 42 to control the operation of various components of the robot 12.

The controller 42 can be operably coupled with various sensors 90 on board the robot 12 for receiving input about the environment and from the docking station 14, and can use the sensor input to control the operation of the robot 12. The sensors 90 can detect features of the surrounding environment of the robot 12 including, but not limited to, the docking station 14, walls, floors, chair legs, table legs, footstools, pets, consumers, and other obstacles. The sensor input can further be stored in the memory 74 or used to develop maps by the navigation/mapping system 40. Some exemplary sensors 90 include: a distance sensor for position/proximity sensing, a bump sensor detecting front or side impacts to the robot 12, a wall following sensor that provides distance feedback so that the robot 12 can follow near a wall without contacting the wall, a cliff sensor that provides distance feedback so that the robot 12 can avoid excessive drops down stairwells, ledges, etc., an inertial measurement unit (IMU) that measures and reports on the robot's acceleration, angular rate, or magnetic field surrounding the robot 12, a lift-up sensor that detects when the robot 12 is lifted off the floor, e.g. if a user picks up the robot 12, a bin or tank sensor that determines the presence or absence of the collection bin 56 or supply tank 48 on the housing 24, a bin full sensor that detects when the collection bin 56 is full and requires emptying, a tank empty sensor that detects when the supply tank 48 is empty and requires refilling, a floor condition sensor that detects a condition of the floor to be cleaned, a mopping implement sensor that detects the presence or absence of the mopping implement 16, a mopping implement condition sensor that detects a condition of the mopping implement 16, or any combination thereof, including multiples thereof. Although it is understood that not all sensors shown may be provided, additional sensors may be provided, and that all of the possible sensors can be provided in any combination. Sensor input can be used to slow down, turn, and/or adjust the course of the robot 12, to select an obstacle avoidance algorithm, to halt operation of one or more motors in response to a detected event, or to dock the robot 12 with the docking station 14.

The robot 12 can have at least one receiver 92 to detect signals emitted from the docking station 14. In one embodiment, a docking signal from the docking station 14 can be transmitted to the robot 12 and received by the receiver 92 to guide the robot 12 to the docking station 14.

The robot 12 can operate in one of a set of modes. The modes can include at least a dry mode and a wet mode. During the wet mode of operation, liquid from the supply tank 48 is dispensed from the fluid distributor 50 and the mopping pads 44 can be rotated. In one embodiment, the mopping system 32 can remove cleaning fluid and debris from the surface to be cleaned without the use of suction. Cleaning fluid and debris can be collected by the mopping pads 44. In another embodiment, during the wet mode, a partial vacuum can be generated at the suction inlet 52 by the suction source 54 to collect liquid and/or debris in the collection bin 56. During the dry mode of operation, the brushroll 60 and/or edge brushes 64 can be rotated to sweep debris into the collection bin 56. No liquid is dispensed from the fluid distributor 50.

When switching from wet cleaning to dry cleaning, the robot 12 may dock at the docking station 14, and the docking station 14 can automatically, e.g. without user intervention, remove the mopping implement 16. When switching from dry cleaning to wet cleaning, the robot 12 may dock at the docking station 14, and the docking station 14 can automatically, e.g. without user intervention, install the mopping implement 16.

The brushroll 60 and/or edge brushes 64 may remain on the housing 24 in both modes. In other embodiments, the docking station 14 may automatically remove and/or install these implements in accordance with a cleaning mode of the robot 12.

Figure 4:
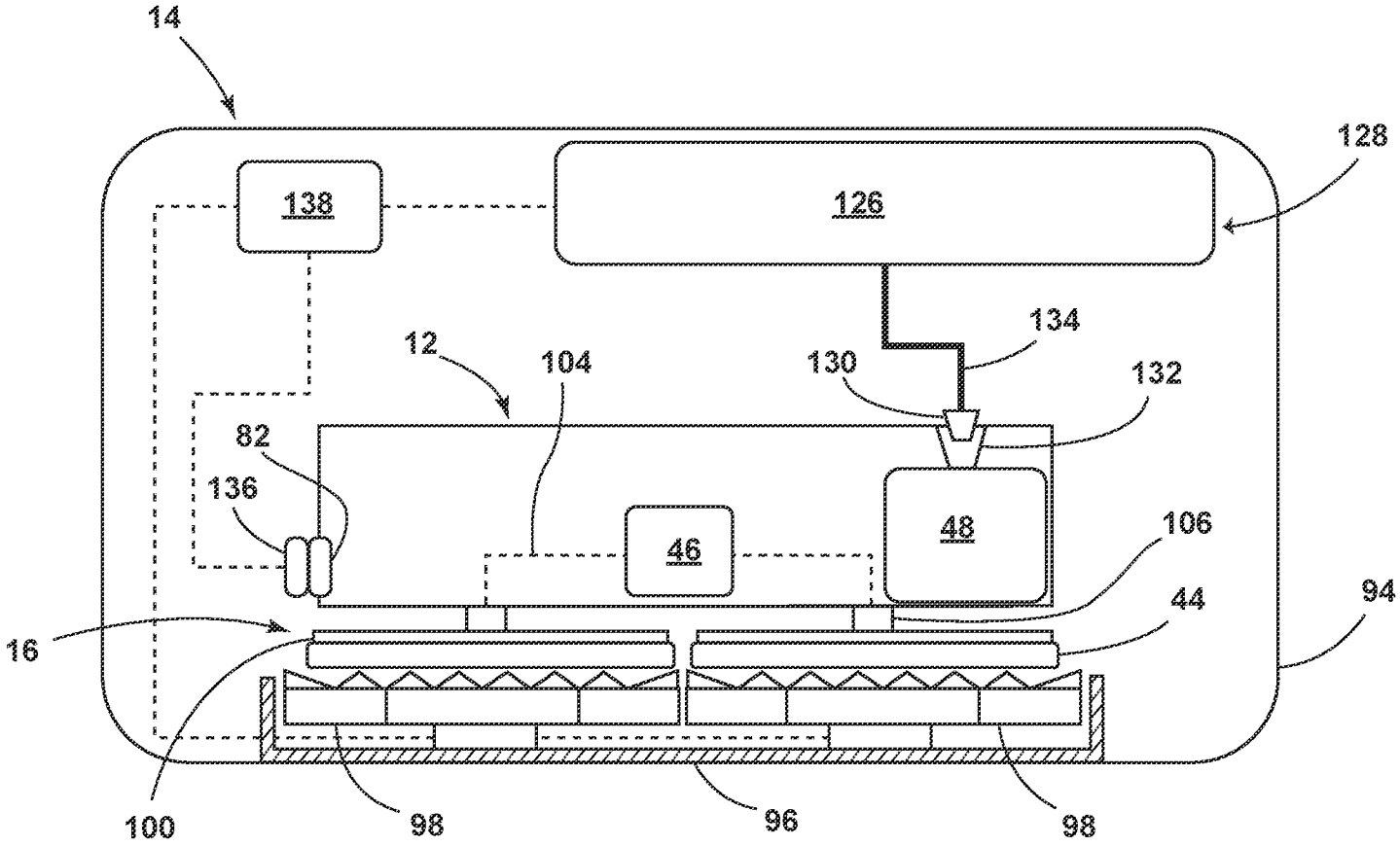
FIG. 4 is a schematic view of the robot docked at the docking station from FIG. 1, the docking station having a mechanism for removing and installing a mopping implement on the robot.

FIG. 4 is a schematic view showing the robot 12 docked at the docking station 14. The docking station 14 provides support for the robot 12 while recharging and removing/installing the mopping implement 16.

The docking station 14 includes a housing 94, and the housing 94 can include a base 96 and at least one moveable platform 98. The base 96 can extend generally horizontally to be disposed on the floor. The base 96 can as large as, or larger than, the footprint of the robot 12, so that the robot 12 is supported entirely by the docking station 14 when docked. This elevates the robot 12 off the floor and can project the floor from damage, particularly if components of the robot 12 remain wet after use. Other shapes and configurations for the housing 94 are possible, including a shape where the housing 94 has an enclosure into which the robot 12 drives.

The base 96 can be solid wall or a framework of the docking station 14, and may define a lower surface of the housing 94 that rests on a floor surface. Alternatively, the base 96 can define a surface of the housing 94 above the surface on which the housing 94 rests.

The docking station 14 can recharge a power supply of the robot 12 (e.g. battery 80 in FIG. 3). Electrical contacts or charging contacts 136 are disposed on the housing 94 and are adapted to mate with the charging contacts 82 on the exterior surface of the robot 12 to recharge the robot 12.

A controller 138 is operably coupled with the various functional systems of the docking station 14 for controlling its operation. The controller 138 can be a microcontroller unit (MCU) that contains at least one central processing unit (CPU). The docking station 14 can include various sensors and emitters for monitoring a status of the robot 12, enabling auto-docking functionality, communicating with the robot 12, as well as features for network and/or Bluetooth connectivity.

The cleaning implement 16 can include pad drivers 100 supporting the mopping pad 44. The pad driver 100 can be rigid plastic support or backing that rotates with the pad 44 and provides rigidity to the pad 44. The mopping pad 44 can be fixedly or removably mounted to the pad driver 100. With a removable mounting, the mopping pad 44 can be detached from the pad driver 100 for cleaning and/or replacement. With the fixed mounting, the mopping pad 44 and pad driver 100 can constitute a replaceable component for the robot 12. Regardless of whether the mopping pad 44 is fixedly or removably mounted to the pad driver 100, the mopping pads 44 and pad drivers 100 can form a pad unit 102 that is removable from the robot 12 by the docking station 14.

The pad driver 100 is operably coupled to and driven by a drive assembly including the motor 46 and a drive coupling or transmission 104 between the pad driver 100 and the motor 46. The transmission 104 transmits the rotational force provided by the motor 46 to a drive output shaft 106. The pad driver 100 is removably mounted to the drive shaft 106, and can have a shaft coupling 108 on a surface of the pad driver 100 opposite a surface on which the pad 44 is attached. The drive shaft 106 can define an axis of rotation of the mopping pad 44.

In FIG. 4, each pad driver 100 has an individual associated platform 98 on the docking station 14. In other configurations, a single platform may service both pad drivers 100.

The platforms 98 are moveable upwardly and downwardly, e.g. toward and away from the robot 12, between a lowered position and a raised position. With the robot 12 docked and the platforms 98 in the lowered position, the platforms 98 are out of contact the mopping pads 44. In the raised position, the platforms 98 contact the mopping pads 44. The platforms 98 can be in the lowered position during robot 12 docking, and may move upward to the raised position once the robot 12 is docked at the docking station 14.

Figure 5A:
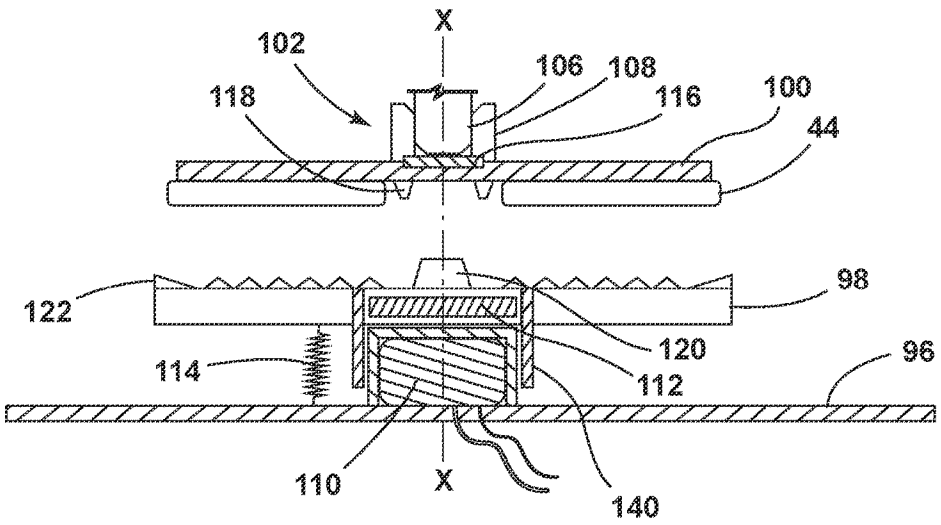
FIG. 5A is a schematic sectional view of a platform of the docking station from FIG. 4, with the platform in a lowered position.
Figure 5B:
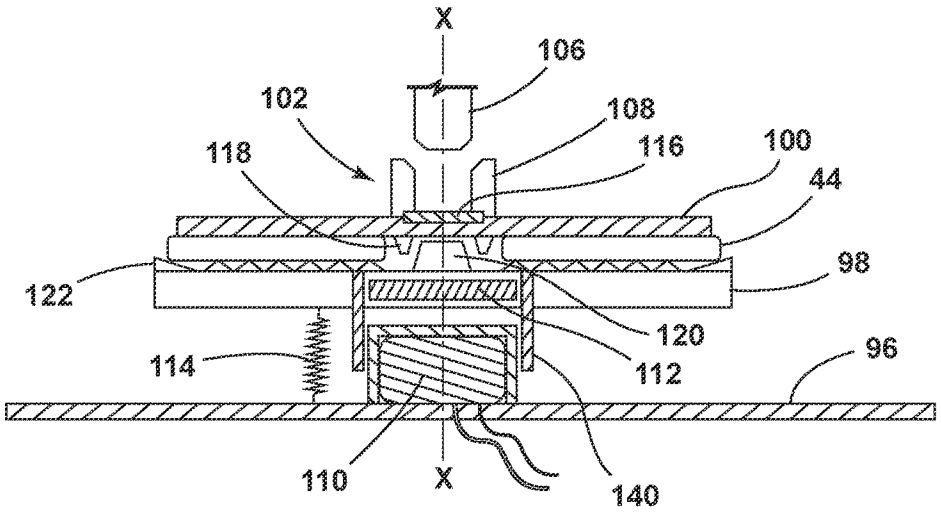
FIG. 5B is a schematic sectional view of a platform of the docking station from FIG. 4 with the platform in a raised position.

Referring to FIGS. 5A-5B, to raise or lower the platform 98, the docking station 14 has an electromagnet 110 in the housing 94 below the platform 98 and the platform 98 can have a magnet 112 embedded or otherwise attached to the platform 98 in a location adjacent to an upper or pad-supporting surface of the platform 98.

When the electromagnet 110 is powered, the platform 98 is moved to the raised position, an example of which is shown in FIG. 5B, by the electromagnetic attraction between the electromagnet 110 and the magnet 112. The electromagnet can be powered by a power source of the docking station, and activated by a signal from the controller 138.

In at least some embodiments, the electromagnet 110 may be selectively activated, based on a signal from the controller 138, in a first polarity and in a second, opposite polarity, e.g., positive and negative, or vice versa. In the first polarity direction, the electromagnet 110 acts to install the pad 44 on the robot 12. In the second, opposite polarity direction, the electromagnet 110 acts to remove for the pad 44 from the robot 12.

When the electromagnet 110 is unpowered, the platform 98 is biased to the lowered position, an example of which is shown in FIG. 5A, either by gravity (e.g., under its own weight) or by at least one spring 114. The spring 114 may, for example, be attached between the base 96 and the platform 98.

In some embodiments, the platform 98 may be moveable beyond the lowered position to which it is biased by the spring 98. For example, where the electromagnet 110 can be activated in opposite polarities to raise and lower the platform 98, the spring 98 is used to keep the platform 98 in an "intermediate" position when the electromagnet is deactivated.

The platform 98 can be constrained for movement along an axis X, for example by a telescopic support 140 that is slidable relative to a portion of the docking station 14 containing the electromagnet 110. The axis X can be normal to the base 96, alternatively normal to the floor on which the base 96 is disposed, alternatively substantially vertical, where "substantially" includes ±5 degrees. Accordingly the platform 98 moves in a direction normal to the base 96, alternatively in a direction normal to the floor on which the base 96 is disposed, alternatively moves substantially vertically or in a substantially vertical direction, where "substantially" includes ±5 degrees.

The pad driver 100 can have a magnetic coupling with the drive shaft 106 to retain the pad unit 102 on the robot 12. For example, the pad driver 100 can have a magnetically-attractable element 116 (e.g. made of a ferromagnetic or ferrimagnetic material) and the drive shaft 106 can be magnetic. The magnetically-attractable element 116 can be a ferrite-metal plate embedded or otherwise attached to the driver 100 in a location adjacent to the shaft coupling 108 so that the drive shaft 106 can magnetically attract the plate when the shaft coupling 108 mates with the drive shaft 106.

When the robot 12 enters its home position on the docking station 14, the pad driver 100 is centered, within some tolerance, over the platform 98. The electromagnet 110 is activated, raising the platform 98. In the first polarity direction, the electromagnet 110 pushes on the platform magnet 112 to raise the platform 98.

Upon activation of the electromagnet 110 in the second, opposite polarity direction, the pad unit 102 is pulled down onto the platform 98 by the electromagnetic attraction between the electromagnet 110 and the magnetically-attractable element 116, releasing the pad unit 102 from the shaft 106. The platform 98 can as large as, or larger than, the mopping pad 44 and/or pad driver 100, so that the pad unit 102 can rest entirely on the platform 98 when released from the robot 12. As the unit 102 is pulled onto the platform 98, alignment features on the platform 98 can help to further center and align the pad driver 100 directly on the middle of the platform 98.

Deactivation of the electromagnet 110 lowers the platform 98, along with the detached pad unit 102, by gravity or by the biasing force of the spring 114, to the lowered position. Alternatively, the electromagnet 110 is activated with a polarity appropriate to pull the platform 98 farther down beyond the lowered position to ensure the shaft coupling 108 clears the drive shaft 106 when the robot 12 leaves the docking station 14.

In the lowered position, platform 98 and the pad unit 102 supported by the platform 98 are low enough to have clearance to all parts of the robot 12 so that the robot 12 can leave the mopping implement 16 behind at the docking station 14, and perform a cleaning operation without the pads 44, such as dry vacuum cleaning.

Additionally, whenever directed by the controller 138, the electromagnet 110 can be powered with a polarity appropriate to push the platform, 98, up against the pad unit 102, for agitation, so cleaning can be performed of the pad (the robot would simultaneously spin the pads, and dispense cleaning solution onto the pads).

As noted above, the platform 98 and/or the pad driver 100 can have alignment features to center the pad driver 100 on the platform 98. In the embodiment shown, the pad driver 100 has a hub receiver 118 and the platform 98 has a centering hub 120 that corrects misalignment of the pad driver 100 on the platform 98. In one example, the hub receiver 118 can be annular and the centering hub 120 can be cone-shaped to guide the pad driver 100 into correct alignment. Other alignment features for centering the pad driver 100 on the platform 98 are possible.

To reinstall the pad unit 102, the electromagnet 110 is activated to raise the platform 98 and pad unit 102 upward, until the shaft coupling 108 on the pad driver 100 engages with the drive shaft 106. Optionally, the pad unit 102 can have an optical flag sensor that gets blocked by a flag on the platform 98 to provide feedback to the robot 12, docking station 14, and/or communication device 22, that the pad unit 102 was installed correctly. At this point, the electromagnet 110 is depowered, and the platform 98 falls back to the lowered position while the pad unit 102 is held in place on the robot 12, by the magnetic coupling with the drive shaft 106.

A pad removal operation and/or a pad installation operation can be executed by the controller 138 on the docking station 14. For example, when the robot 12 is docked at the docking station 14, and a charging connection is established, the docking station 14 can issue a command to initiate removal of the mopping pads 44. In some examples, the controller 138 sends a communication to the robot 12 and will only initiate the pad removal operation if the controller 138 receives a response to this communication from the robot 12. Additionally or alternatively, when a charging connection is established, the controller 138 can execute a charging operation to recharge the battery 80 of the robot 12. In other examples, when a charging connection is established, the robot 12 can issue a command to the docking station 14 to initiate the pad removal operation. The robot 12 can transmit the command to the docking station 14 through electrical signals, optical signals, or other appropriate signals.

The docking station 14 of FIG. 4 can perform additional service, maintenance, or diagnostic checks on the robot 12 when docked. For example, the docking station 14 can be configured to clean the mopping implement 16 and/or automatically fill or refill the supply tank 48.

As shown in FIG. 4-5B, the platforms 98 include scrubbers 124 configured to engage the mopping pads 44 when the robot 12 is docked and the platforms 98 are raised, the scrubbers 124 including one or more scrubbing features for physically scrubbing or agitating the mopping pads 44.

The scrubbers 124 can comprise a plurality of raised elements, such as nodules, nubs, bristles, paddles, blades, and the like, extending away from the pad-facing surface of the platform 98 to engage with the pads 44. In another embodiment, the raised elements can comprise a textured pattern on the platform 98. The size, shape, density, and distribution of the raised elements provides a highly favorable texture for washing the mopping pads 44.

Each platform 98 can as large as, or larger than, the mopping pads 44, so that the entire mopping pad 44 can be engaged by the scrubber 124 on the platform 98 when raised. This ensures the entire floor-engaging surface of the mopping pads 44 are scrubbed clean.

When the robot 12 is docked at the docking station 14, a pad cleaning cycle can be executed by either, or a combination of, the controller 42 of the robot 12 and the controller 138 on the docking station 14. For example, when a charging connection is established, the docking station 14 can issue a command to the robot 12 to initiate rotation of the mopping pads 44. In some examples, the controller 138 sends a communication to the robot 12 and will only initiate the pad cleaning cycle if the controller 138 receives a response to this communication from the robot 12. In other examples, when a charging connection is established, the robot 12 can issue a command to the docking station 14 to initiate the pad cleaning cycle. The robot 12 can transmit the command to the docking station 14 through electrical signals, optical signals, or other appropriate signals.

During the pad cleaning cycle, cleaning fluid is dispensed to clean the mopping pads 44 while the pad drivers 100 are rotated. Such cleaning fluid may be dispensed from the robot's supply tank 48 or from a supply tank on the docking station 14. After a predetermined period of time, such as 1-3 minutes or when it is determined that the pads 44 are sufficiently cleaned, the cleaning cycle may end. Alternatively, the pads 44 can continue to rotate every once-in-a-while to facilitate drying.

The platform 98 can include a reservoir 122 for collecting the cleaning fluid used to clean the mopping pads 44. In addition, the reservoir 122 may retain cleaning fluid that drips off the mopping pads 44 during storage at the docking station 14. The reservoir 122 can be defined by a raised lip or edge around the perimeter of the platform 98, which defines the confines of the reservoir 122.

At the end of the pad cleaning cycle, the pad units 102 may be removed by the docking station 14 as previously described, and left at the docking station 14 to dry while the robot 12 continues cleaning. For example, the robot 12 may switch to a dry vacuum cleaning operation while the pads 44 dry. Alternatively, the pad units 102 may be left on the robot 12 if the robot 12 is to continue wet cleaning or is to remain docked for a period of time.

Optionally, the pad cleaning cycle can include raising the platform 98. Raising the platform 98 can include activating, based on a signal from the controller 138, the electromagnet 110 with a polarity appropriate to push the platform 98 up against the pad unit 102 for more intense agitation.

In some embodiments, the robot 12 can determine that pad cleaning is required, and then return to the docking station 14 to clean the mopping pads 44. This can prevent the robot 12 from continuing to wet clean when the mopping pads 44 are too dirty to be effective. Dirtiness can be determined by sensors (e.g. sensor 90) on the robot 12 that detect how dirty the pads 44 are. Sensor input is used to determine that a threshold level of dirtiness is reached, upon which the robot 12 returns to the docking station 14 to clean the pads 44. In another embodiment, the robot 12 returns to the docking station 14 to clean the pads 44 after a predetermined operating time has been surpassed. In another embodiment, the robot 12 returns to the docking station 14 to clean the pads 44 when the supply tank 48 requires refilling. In another embodiment, the robot 12 returns to the docking station 14 to clean the pads 44 when the battery 80 requires recharging. In some embodiments, the docking station 14 can determine whether pad cleaning is required when the robot 12 docks at the docking station 14.

For refilling the robot's supply tank 48 and cleaning the mopping pads 44, the docking station 14 can include a storage tank 126 configured to hold a supply of cleaning fluid, and a refilling mechanism 128 that refills the robot's supply tank 48 with cleaning fluid from the storage tank 126. The cleaning fluid can be a liquid such as water or a cleaning solution specifically formulated for cleaning the mopping pads 44. The capacity of the storage tank 126 may be sufficient to refill the robot's supply tank 48 at least once, and preferably multiple times.

The refilling mechanism 128 can include refilling port 130 on the docking station 14 configured to couple with a tank port 132 on the robot 12 and at least one supply conduit 134 or other structure for conveying liquid from the storage tank 126 to the refilling port 130.

When the robot 12 docks with the docking station 14, a fluid connection can be established between the refilling port 130 and the tank port 132. This connection can be made automatically, e.g. without user intervention, including being established passively during the driving action of the robot 12 onto the docking station 14 or being established actively, such by using motors, solenoids, and the like, to move one or both of the ports 130, 132 into engagement with each other. The docking station 14 can include features that assist in alignment of the robot 12 to the refilling port 130 or other elements, either through mechanical or electrical means.

The refilling mechanism 128 can also include appropriate flow control components to control the distribution of cleaning fluid from the storage tank 126 to the refilling port 130. Once the ports 130, 132 are connected, the refilling mechanism 128 can move cleaning fluid from the storage tank 126 to the supply tank 48 until the supply tank 48 is full.

When the robot 12 is docked at the docking station 14, a refilling operation can be executed by the controller 138 on the docking station 14. For example, when a charging connection is established, the docking station 14 can issue a command to initiate refilling the robot supply tank 48. In some examples, the controller 138 sends a communication to the robot 12 and will only initiate the refilling operation if the controller 138 receives a response to this communication from the robot 12. In other examples, when a charging connection is established, the robot 12 can issue a command to the docking station 14 to initiate the refilling operation. The robot 12 can transmit the command to the docking station 14 through electrical signals, optical signals, or other appropriate signals.

Figure 6:
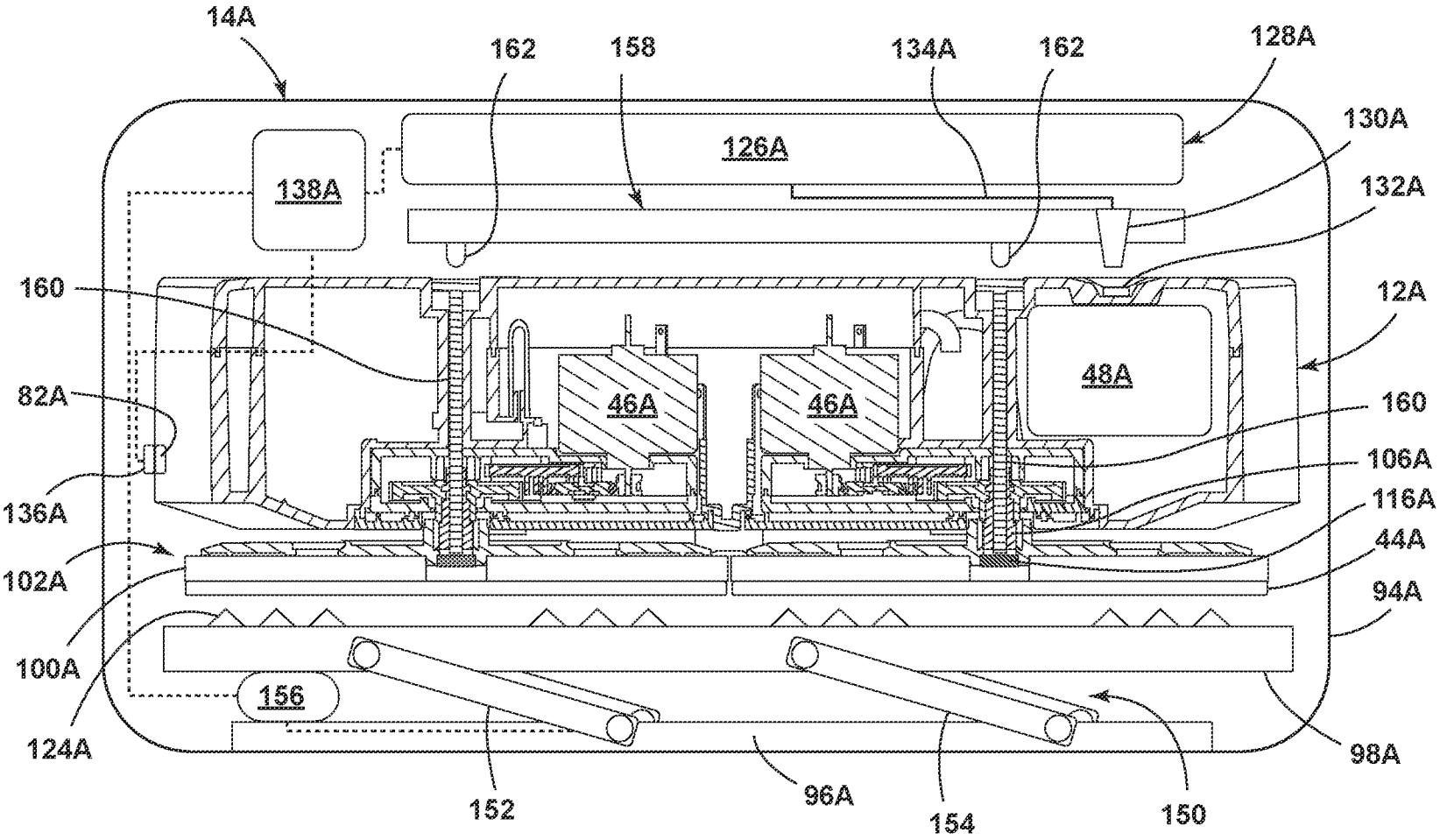
FIG. 6 is a schematic view of an autonomous floor cleaning system according to another aspect of the disclosure.

FIG. 6 is a schematic view showing an autonomous floor cleaning system according to another aspect of the disclosure, the system including at least an autonomous floor cleaner, or robot 12A, and a docking station 14A. For brevity of the disclosure, like elements in FIG. 6 are referred to with the same reference numerals as in FIG. 4-5B, bearing a letter "A."

The docking station 14A has a platform movement mechanism comprising a four-bar linkage 150 to raise and lower the platform 98A relative to the base 96A. The bodies making up the four-bar linkage 150 can include the platform 98A, the base 96A, and two spaced links 152, 154 connected in a loop by joints. As shown, to provide support on either side of the platform 98A, a second set of links 152, 154 can be provided.

The four-bar linkage 150 is operably coupled to a motor 156, which can provide driving input to raise or lower the platform 98A, for example by rotating the links 152, 154. In FIG. 6, the platform 98A is shown in a lowered position.

In the configuration illustrated, one platform 98A services both pad drivers 100A. In other configurations, each pad driver 100A can have an individual associated platform on the docking station 14, with each platform having a four-bar linkage mechanism to raise and lower the platform.

The refilling port 130A on the docking station 14A can be carried by a downcomer assembly 158 configured to move downwardly, e.g. toward the robot 12A, to establish a fluid connection between the refilling port 130A and the tank port 132A. When the robot 12A docks with the docking station 14A, this connection can be made automatically, e.g. without user intervention, including being established actively, such by using motors, solenoids, and the like, to move the downcomer assembly 158 downward to bring the refilling port 130A into engagement with the refill port 132A. Once the ports 130A, 132A are connected, the supply tank 48A is refilled. After refilling the supply tank 48A, the downcomer assembly 158 moves upwardly to release the fluid connection.

To automatically detach and attach the pads 44, the robot 12A has a push rod 160 for each pad driver 100A, and the downcomer assembly 158 can include push rod actuators or other features 162 that engage the push rods 160 to force the push rods 160 down when the downcomer assembly 158 is lowered. The push rods 160 may be spring-biased to a raised position, such that the push rods 160 raise when the downcomer assembly 158 raises.

The push rods 160 are configured to apply force to the pad drivers 100A to release the coupling with the drive shaft 106A. As described for the previous embodiment, the pad driver 100A can have a magnetic coupling with the drive shaft 106A, with the force applied by the push rods 160 serving to overpower the magnetic attraction holding the pad drivers 100A on the drive shafts 106A. The push rods 160 can, for example, extend through the drive shafts 106A to selectively engage a surface of the pad driver 100A opposite a surface on which the pad 44A is attached.

In another configuration, the pad driver 100A can have a mechanical coupling with the drive shaft 106A, with the force applied by the push rods 160 serving to release the mechanical coupling. One example of a suitable mechanical coupling is a spring-loaded detent mechanism embedded in the pad drivers 100A, where the force applied by the push rods 160 releases the spring-loaded detent mechanism.

When the robot 12A enters its home position on the docking station 14A, the pad drivers 100A are aligned, within some tolerance, over the platform 98A. Activation of the downcomer assembly 158 forces the push rods 160 down, releasing the coupling between the pad drivers 100A and the drive shafts 106A and releasing the pad units 102A from the robot 12A. The platform 98A can as large as, or larger than, both mopping pads 44A and/or pad drivers 100A, so that the pad units 102A can rest entirely on the platform 98A when released from the robot 12A. As the units 102A are pushed onto the platform 98A, alignment features (not shown) on the platform 98A can help to locate the pad drivers 100A on the platform 98A for a later reattachment of the pad drivers 100A.

It is noted that activation of the downcomer assembly 158 also establishes a fluid connection between the refilling port 130A and the tank port 132A, and this fluid connection can occur before, after, or simultaneously with releasing the pad units 102A.

To reattach the pad units 102A, with the downcomer assembly 158 raised, the platform 98A is moved to the raised position. For example, during reinstallation, the motor 156 is powered to lift the platform 98A up, and press the pad drivers 100A back onto the drive shafts 106A. The pad drivers 100 are retained, for example, by the magnetic attraction between the drive shafts 106A and the magnetically-attractable elements 116A.

As with the previous embodiment, when the robot 12A is docked at the docking station 14A, a pad removal operation and/or a pad installation operation can be executed by the controller 138A on the docking station 14A.

The docking station 14A of FIG. 6 can perform additional service, maintenance, or diagnostic checks on the robot 12A when docked. For example, the docking station 14A can be configured to clean the mopping implement 16A and/or automatically fill or refill the supply tank 48A.

Figure 7:
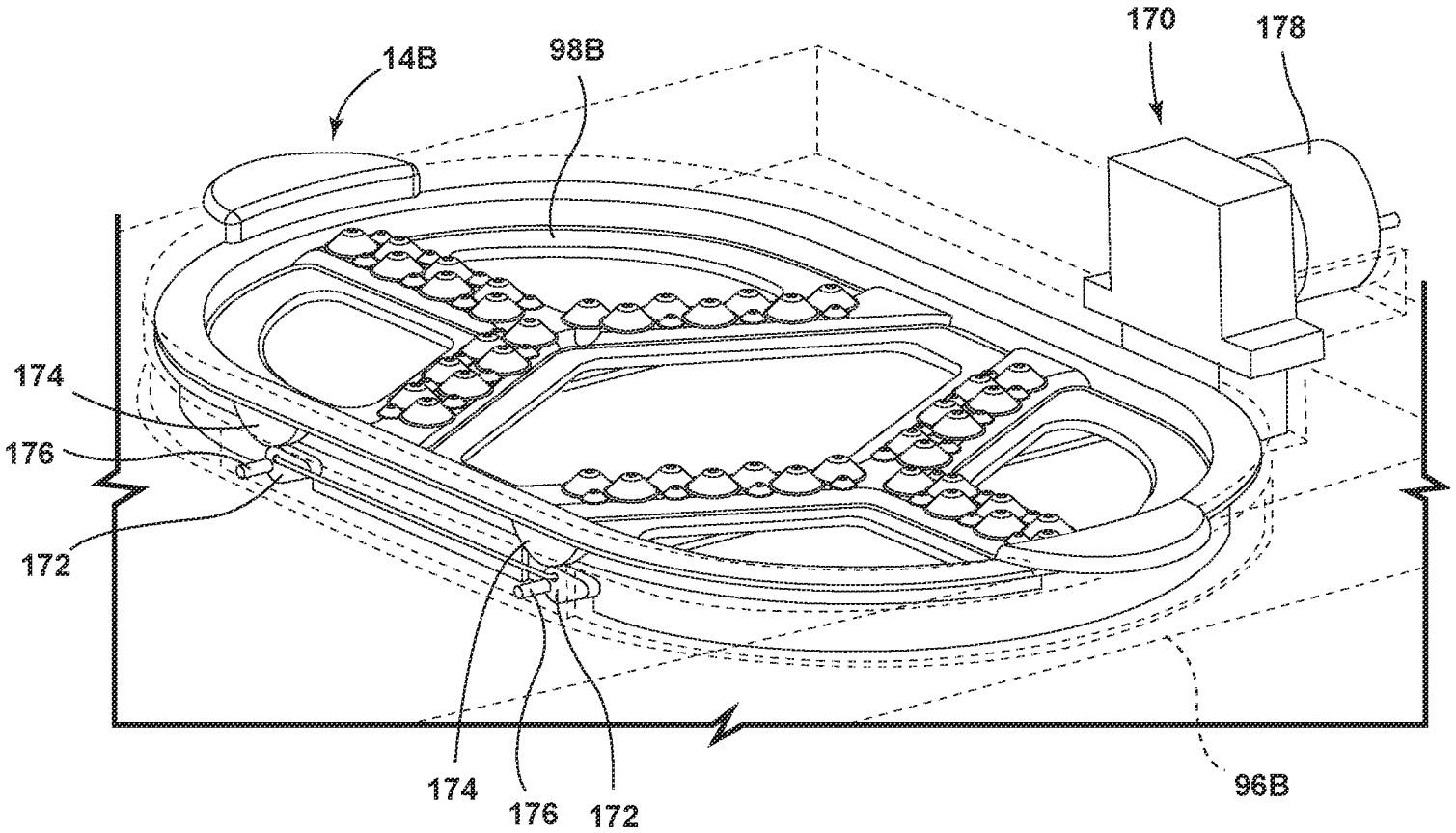
FIG. 7 is a schematic perspective view of a docking station according to yet another aspect of the disclosure.

FIG. 7 is a schematic view showing a docking station 14B according to another aspect of the disclosure. For brevity of the disclosure, like elements in FIG. 7 are referred to with the same reference numerals as in FIG. 4-5B, bearing a letter "B." The docking station 14B has a platform movement mechanism comprising a cam-based lift mechanism 170 to raise and lower the platform 98B relative to the base 96B. The cam-based lift mechanism 170 includes a plurality of cams 172 that transmit motion to followers 174 on the platform 98B. The cams 172 are configured to rotate while the followers 174 translate up and down.

The cams 172 can be mounted on rods 176 which are operably connected with a motor 178 through a transmission (not shown), which may include one or more belts, gears, pulleys, linkages, and the like. In operation, the motor 178 turns the rods 176 to rotate the cams 172, which lifts and lowers the platform 98B in a linear, reciprocating motion.

The cam-based lift mechanism 170 can be combined with aspects other docking stations disclosed herein, such as docking station 14 or 14A, to perform service, maintenance, or diagnostic checks on a robot when docked, including, but not limited to, removing/installing a mopping implement, cleaning a mopping implement and/or automatically refilling a supply tank.

Figure 8:
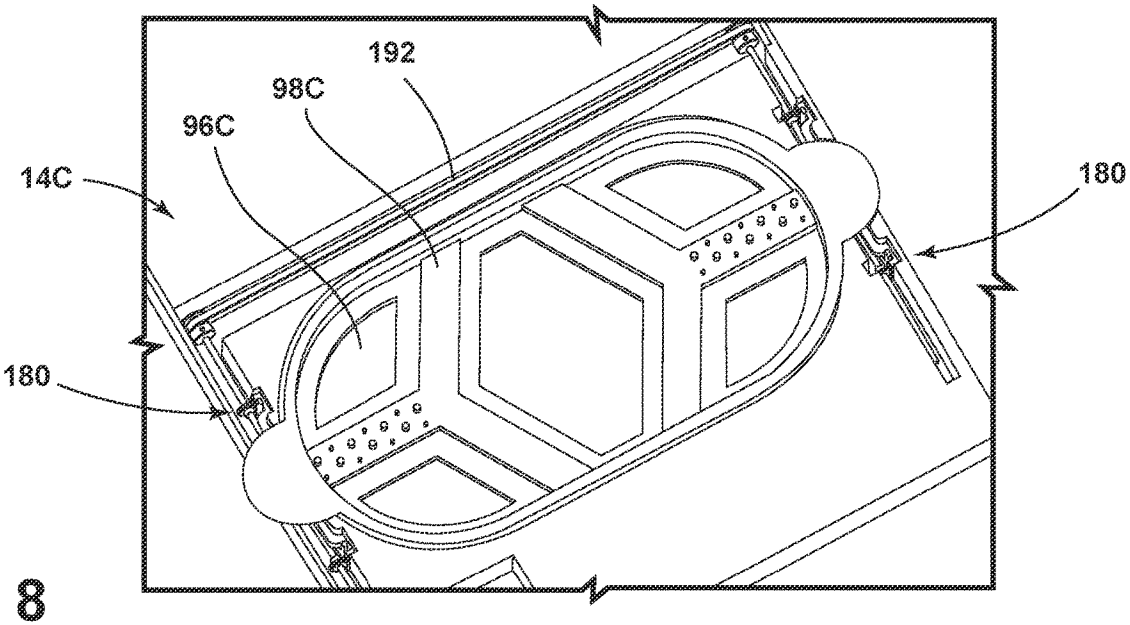
FIG. 8 is a schematic perspective view of a docking station according to still another aspect of the disclosure.
Figure 9:
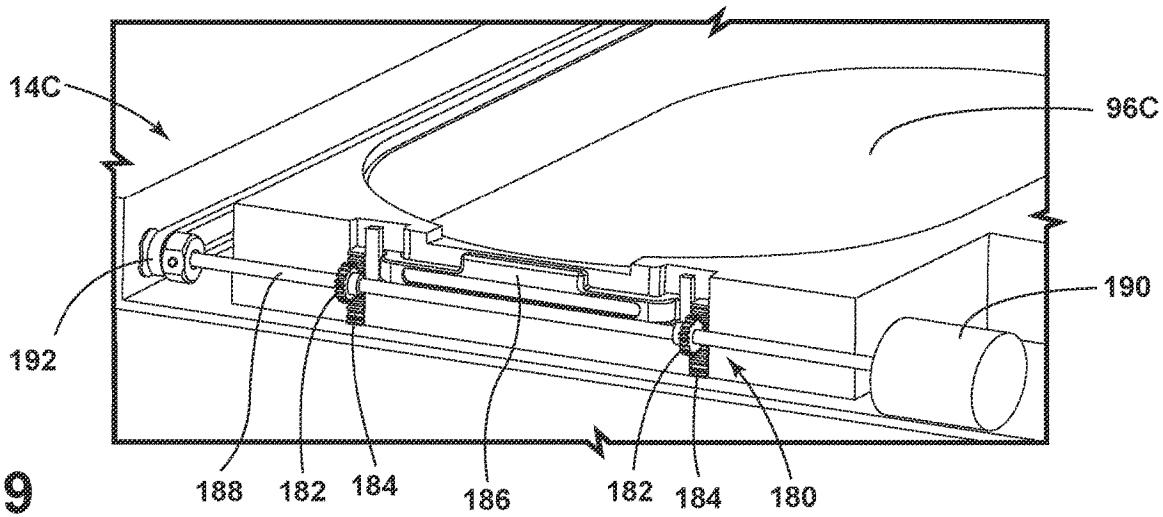
FIG. 9 is a close-up view of view of a mechanism for raising a lowering a platform on the docking station.

FIGS. 8-9 show a docking station 14C according to another aspect of the disclosure. For brevity of the disclosure, like elements in FIGS. 8-9 are referred to with the same reference numerals as in FIGS. 4-5B, bearing a letter "C." The docking station 14C has a platform movement mechanism comprising a rack-and-pinion lift mechanism 180 to raise and lower the platform 98C relative to the base 96C. The rack-and-pinion lift mechanism 180 includes at least one pinion gear 182 that meshes with a rack gear 184 on a platform lifter 186. The rack gear 184 can be vertically oriented to translate vertically, e.g., up and down, by rotation of the pinion gear 182. The rack gear 184 is coupled to or otherwise formed with the platform lifter 186 such that translation of the rack gear 184 up and down also translates the platform lifter 186 up and down. The platform 98C is coupled to, formed with, or otherwise engaged with the platform lifter 186 to move with the platform lifter 186.

In the embodiment shown, the platform lifter 186 has two spaced rack gears 184 that enmesh with pinion gears 182 mounted on rod 188. The rod 188 is operably connected with a motor 190 through a transmission (not shown), which may include one or more belts, gears, pulleys, linkages, and the like. In operation, the motor 190 turns the rod 188 to rotate the pinion gears 182, which translates the platform lifter 186 up or down, depending on the rotational direction of the pinion gears 182, to lift or lower the platform 98C.

As shown in FIG. 8, two rack-and-pinion lift mechanisms 180 can be provided, with one at each end of the platform 98C. Optionally, both mechanisms 180 can by driven by the motor 190, with one rod 188 serving as a drive rod and being coupled with the motor 190, and the other rod 188 serving as a driven rod that is connected to the drive rod by a belt 192. In other configurations, the platform 98C is moveable via a single rack-and-pinion lift mechanism 180.

Figure 10:
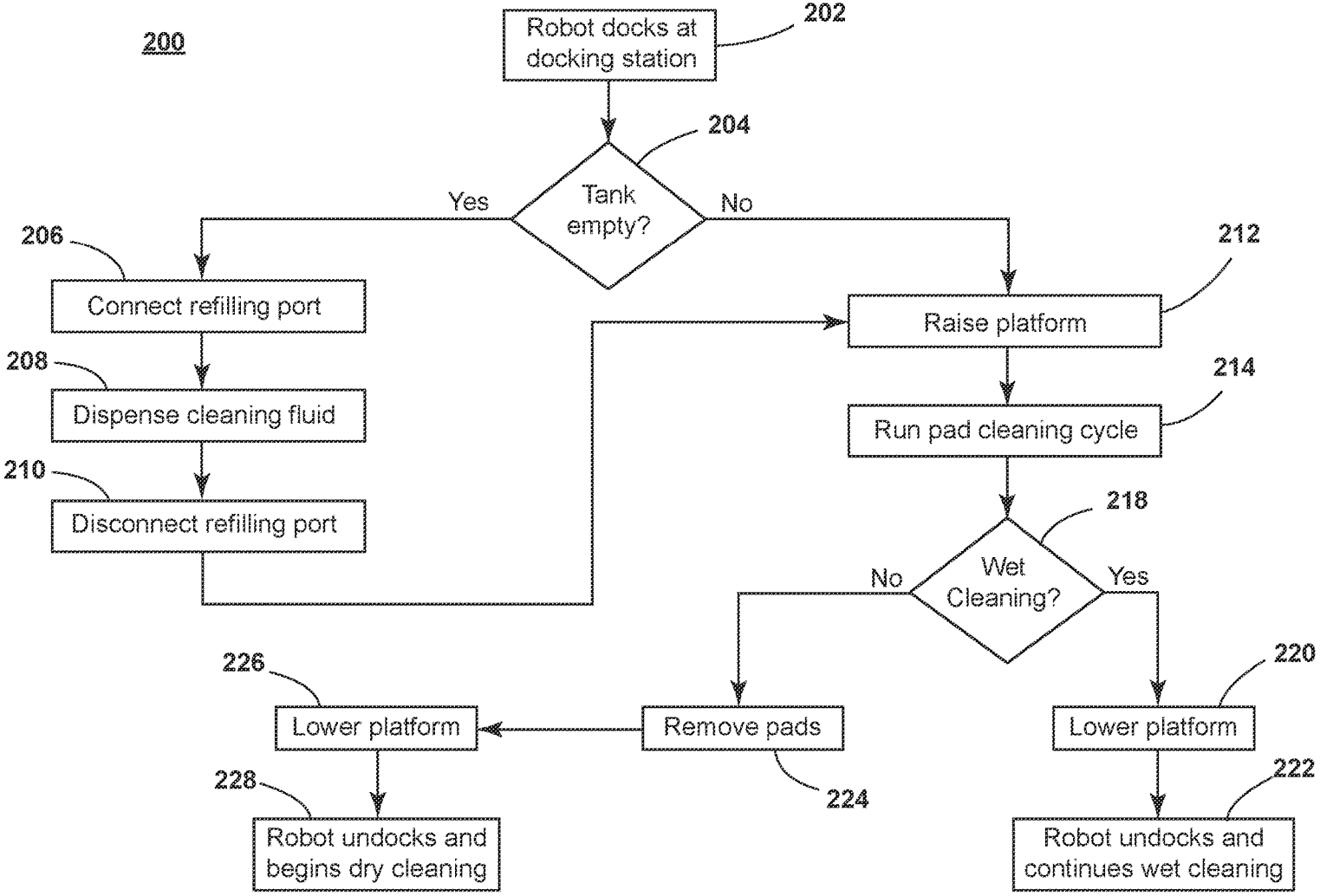
FIG. 10 is a flow chart showing a method for servicing a robot at a docking station.
Figure 11:
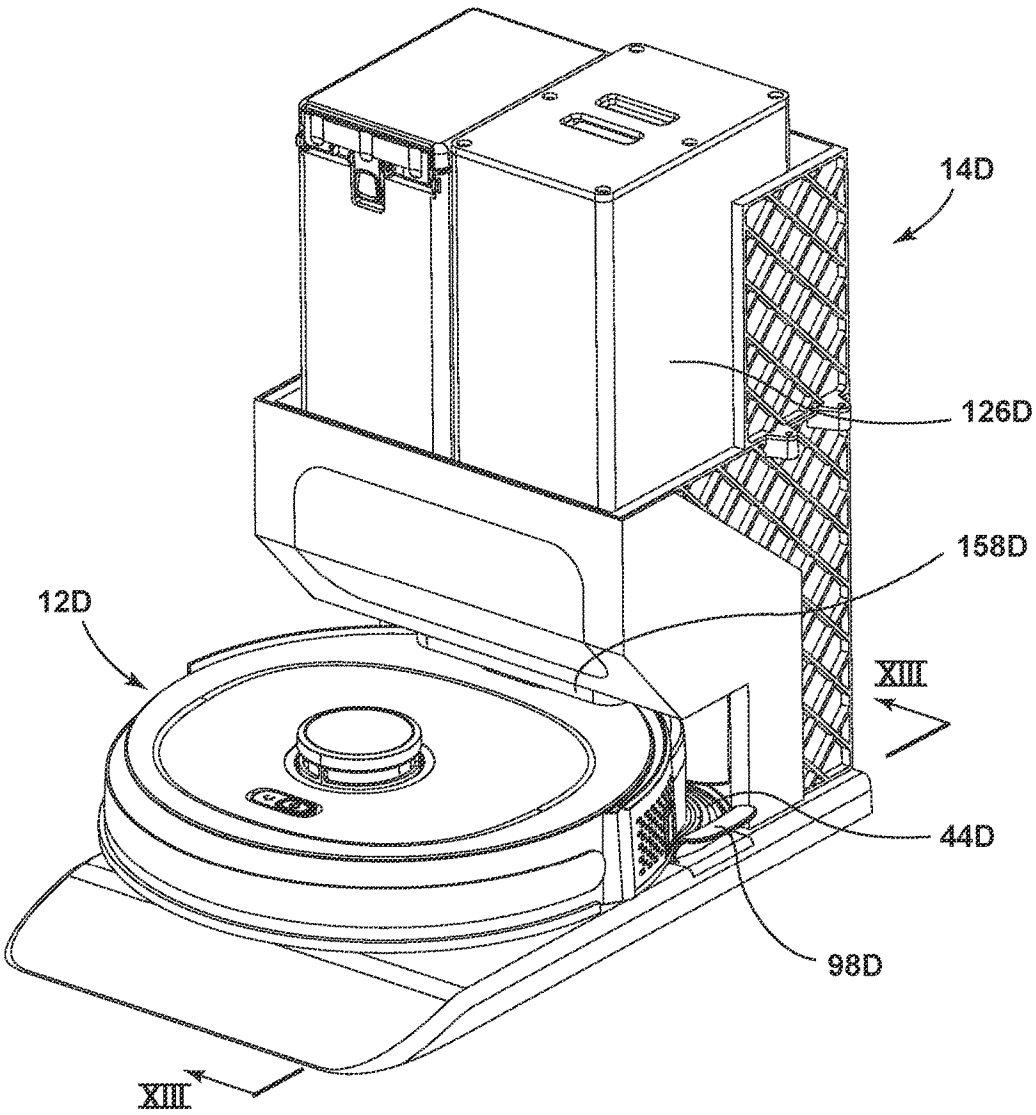
FIG. 11 is a perspective view of an autonomous floor cleaning system according to a further aspect of the disclosure.

FIG. 10 is a flow chart showing a method 200 for servicing a robot at a docking station. The method may be executed using, but is not limited to, any docking station and/or robot disclosed herein. For purposes of description, reference numerals present in FIG. 4-5B are referred to for the method 200.

At step 202, the robot 12 docks with the docking station 14. The robot 12 docks with the docking station 14 upon a return-to-dock event, some non-limiting examples of which include when switching between cleaning modes, when the pads 44 require cleaning, when the supply tank 48 requires filling, when the battery 80 requires charging, when cleaning is complete, and/or a user manually initiates a return-to-dock event.

At step 204, the robot 12 and/or the docking station 14 can determine whether the supply tank 48 is empty. If the tank 48 is empty or otherwise does not contain sufficient cleaning fluid for pad cleaning, at step 206, the refilling port 130 and refill ports 132 are connected, at step 208 cleaning fluid is dispensed from the docking station 14 to the supply tank 48, and at step 210 the refilling port 130 and refill ports 132 are disconnected. Initiating a refilling operation at step 208 can power one or more components of the docking station 14. For example, at step 208 the refilling mechanism 128 can be powered to deliver cleaning fluid from the storage tank 126 to the robot's supply tank 48. Optionally, at step 210, the robot 12, the docking station 14, and/or a smart device application executed on a mobile or remote device can alert the user that the supply tank 48 has been refilled, such as by providing a visual and/or audible user notification.

If the tank 48 is not empty at step 204, alternatively if the tank 48 contains sufficient cleaning fluid for pad cleaning, the platforms 98 are raised at step 212 to contact the mopping pads 44. Raising the platforms 98 can include powering one or more components of the docking station 14. For example, at step 212 the electromagnet 110 can be powered.

At step 214, pad cleaning initiates. A pad cleaning cycle can be executed by the controller 138 of the docking station 14 and/or the controller 42 of the robot 12. Initiating the cleaning cycle at step 214 can power one or more components of the robot 12. For example, at step 214 the mopping pad motor 46 can be powered to rotate the mopping pads 44 to scrub the pads 44 against the scrubbers 124. In one embodiment, the motor 46 is powered continuously. In another embodiment, the motor 46 can pulse on/off intermittently. Optionally, the pads 44 can be rotated at slower or faster speeds to facilitate more effective wetting and/or shedding of debris.

After a predetermined period of time or when it is determined that the pads 44 are sufficiently cleaned, the cleaning cycle may end. Alternatively, the pads 44 can continue to rotate every once-in-a-while to facilitate drying. Optionally, at the end of the cleaning cycle, the robot 12, the docking station 14, and/or a smart device application executed on a mobile or remote device can alert the user that the cleaning cycle has ended, such as by providing a visual and/or audible user notification.

At step 218, the robot 12 and/or the docking station 14 can determine whether the robot 12 is to resume a wet cleaning operation or whether it is to switch to a dry cleaning operation. If the robot 12 is to resume a wet cleaning operation, at step 220 the platforms 98 are lowered, and at step 222 the robot 12 undocks, e.g. leaves the docking station 14 and continues wet cleaning. Optionally, at step 222, the robot 12, the docking station 14, and/or a smart device application executed on a mobile or remote device can alert the user that wet cleaning has resumed, such as by providing a visual and/or audible user notification.

If the robot 12 is to switch to a dry cleaning operation at step 218, the mopping pads 44 are removed at step 224. A pad removal operation can be executed by the controller 138 of the docking station 14. Pad removal at step 224 can include powering one or more components of the docking station 14. For example, at step 224 the electromagnet 110 may be powered. Optionally, at step 224, the robot 12, the docking station 14, and/or a smart device application executed on a mobile or remote device can alert the user that the mopping pads 44 have been removed, such as by providing a visual and/or audible user notification.

Once the mopping pads 44 are removed and/or as part of the pad removal operation, at step 226 the platforms 98 are lowered. At step 228, the robot 12 undocks, e.g. leaves the docking station 14, and begins a dry cleaning operation. Optionally, at step 228, the robot 12, the docking station 14, and/or a smart device application executed on a mobile or remote device can alert the user that dry cleaning has begun, such as by providing a visual and/or audible user notification.

It is noted that the sequence of steps discussed is for illustrative purposes only and is not meant to limit method 200 in any way as it is understood that the steps may proceed in a different logical order, additional or intervening steps may be included, or described steps may be divided into multiple steps, without detracting from the invention. For example, for the embodiment of FIG. 6, step 206 can comprise lowering the downcomer assembly 158, which may also remove the pads 44, and step 210 can comprise raising the downcomer assembly 158. Steps 212, 220, and 226 may include powering the motor 156. Likewise, for the embodiments of FIG. 7-9, steps 212, 220, and 226 may include powering motor 178 or motor 190.

It is noted steps of method 200 may be applicable when installing the mopping pads 44 on the robot 12 for a wet cleaning operation, including, but not limited to, refilling the robot's supply tank 48, raising the platform, and lowering the platform.

FIGS. 11-14 show an autonomous floor cleaning system according to a further aspect of the disclosure, the system including at least an autonomous floor cleaner, or robot 12D, and a docking station 14D. For brevity of the disclosure, like elements in FIGS. 11-14 are referred to with the same reference numerals as in FIG. 6, bearing a letter "D." The docking station 14DC has a platform movement mechanism comprising a rack-and-pinion lift mechanism 230 to raise and lower the platform 98D relative to the base 96D.

The rack-and-pinion lift mechanism 230 includes at least one pinion gear 232 that meshes with a rack gear 234 coupled to a platform lifter 236. The rack gear 234 can be horizontally oriented to translate horizontally, e.g., forward and backward, or left and right, by rotation of the pinion gear 232. The rack gear 234 is coupled to or otherwise formed on the platform lifter 236 such that translation of the rack gear 234 horizontally also translates the platform lifter 236 horizontally.

The docking station 14D can have a track 238 for guiding the rack gear 234 and/or platform lifter 236 horizontally. The pinion gear 232 and track 238 have fixed positions within the docking station 14D, such that rotation of the pinion gear 232 moves the rack gear 234, and therefore the platform lifter 236, along the track 238.

The platform 98D is coupled to, formed with, or otherwise engaged with the platform lifter 236 to move up and down as the platform lifter 236 moves horizontally. The platform lifter 236 includes at least one ramp 240 that aids in raising and lowering the platform 98D vertically. The use of the ramp 240 decreases the force required to lift the platform 98D, in comparison to the vertically-oriented rack-and-pinion lift mechanism 180 of FIG. 9, at the cost of increasing the distance the rack gear 234 moves.

The ramp 240 can be coupled to, or otherwise formed with, the platform lifter 236, and can be disposed forwardly of the rack gear 234. In another embodiment, the ramp 240 can be disposed rearwardly of the rack gear 234, laterally of the rack gear 234, or above the rack gear 234 (e.g. with the teeth of the rack gear 234 facing downwardly).

The ramp 240 can be positioned to engage a lift member 242 or another portion of the platform 98D. The lift member 242 can slide along the inclined surface of the ramp 240 as the platform lifter 236 translates horizontally, thereby moving up or down the ramp 240 and raising or lowering the platform 98D.

In the embodiment shown, the platform lifter 236 has two spaced ramps 240 that are arranged in line with each other and with the rack gear 234, although other numbers of ramps are possible. Translation of the rack gear 234 horizontally thereby also translates the ramps 240 horizontally. The platform 98D can have the same number of lift members 242 as the number of ramps 240.

The platform lifter 236 may include a lower rest surface 244 at the bottom of each ramp 240 and/or an upper rest surface 246 at the top of each ramp 240. The rest surfaces 244, 246 are relatively flat (in comparison to the inclined surface of the ramp 240) surfaces that provide stability to the platform 98D in the raised and lowered positions. In the lowered position, the lift members 242 of the platform 98D can be supported on the lower rest surfaces 244. In the raised position, the lift members 242 of the platform 98D can be supported on the upper rest surfaces 246.

Figure 13:
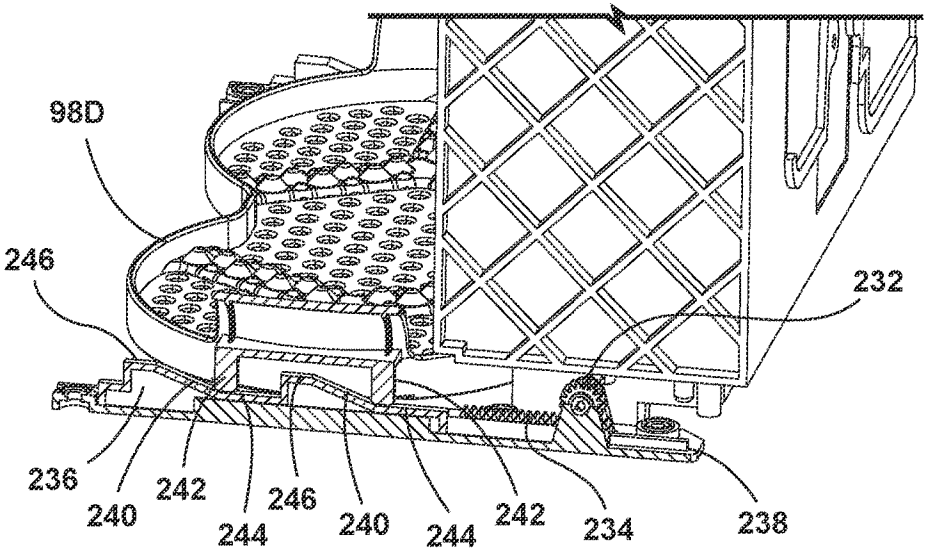
FIG. 13 is a sectional view of the docking station taken through line XIII-XII from FIG. 11, showing the platform in a lowered position.
Figure 14:
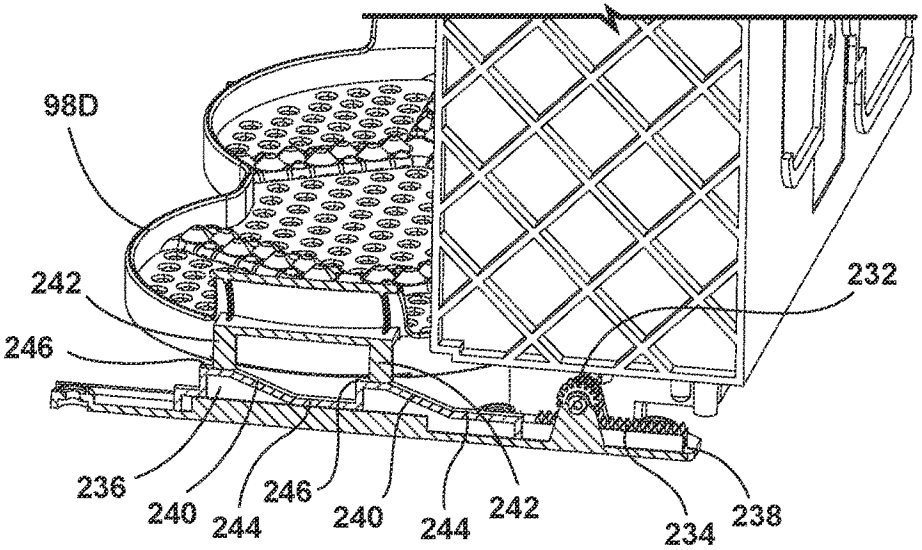
FIG. 14 is a view similar to FIG. 13, showing the platform in a raised position.

The pinion gear 232 is mounted on a rod 248. The rod 248 is operably connected with a motor 250 through a transmission 252, which may include one or more belts, gears, pulleys, linkages, and the like. In operation, the motor 250 turns the rod 248 to rotate the pinion gear 232, which translates the platform lifter 236 forward or backward, depending on the rotational direction of the pinion gear 232, to lift or lower the platform 98D. In the embodiment shown, backward translation of the platform lifter 236 raises the platform 98D and forward translation of the platform lifter 236 lowers the platform 98D. One example of the lowered position is shown in FIG. 13 and one example of the raised position is shown in FIG. 14. In other embodiments, the raising and lowering directions may be reversed, for example by positioning the pinion and rack gears 232, 234 at the forward end of the platform lifter 236.

Figure 12:
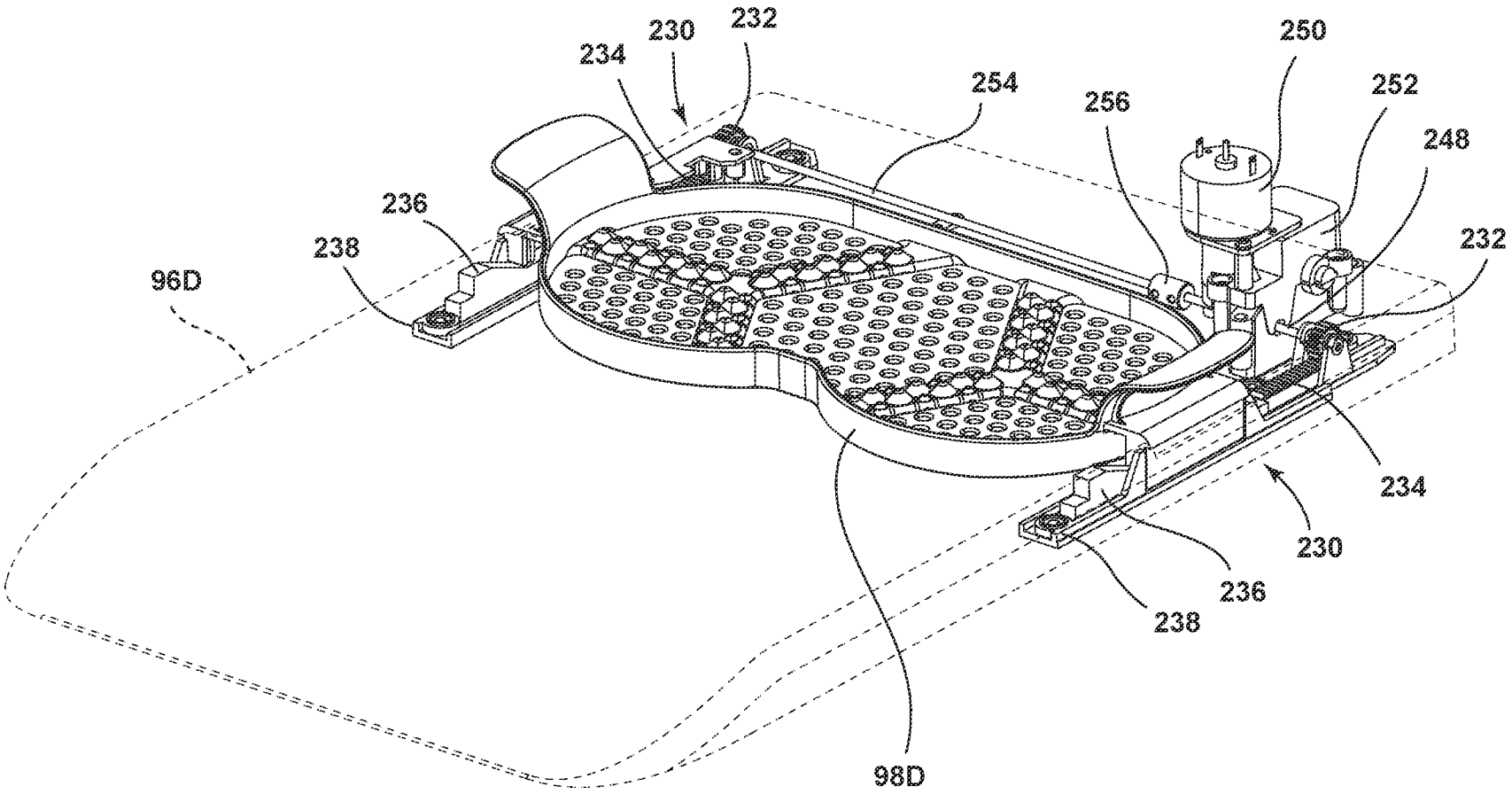
FIG. 12 is a close-up view of view of a mechanism for raising a lowering a platform on the docking station of FIG. 11, with a base of the docking station shown in phantom line for clarity.

As shown in FIG. 12, two rack-and-pinion lift mechanisms 230 can be provided, with one at each end of the platform 98D. Optionally, both mechanisms 230 can by driven by the motor 250, with one rod 248 serving as a drive rod and being coupled with the motor 250, and another rod 254 serving as a driven rod that is connected to the drive rod 248 by a coupler 256, or other connecting means, such as a belt. In other configurations, the platform 98D is moveable via a single rack-and-pinion lift mechanism 230.

To the extent not already described, the different features and structures of the various embodiments of the invention, may be used in combination with each other as desired, or may be used separately. That one autonomous floor cleaning system, robot, or docking station is illustrated herein as having the described features does not mean that all of these features must be used in combination, but rather done so here for brevity of description. Any of the disclosed docking stations may be provided independently of any of the disclosed robots, and vice versa. Further, while multiple methods are disclosed herein, one of the disclosed methods may be performed independently, or more than one of the disclosed methods, including any combination of methods disclosed herein may be performed by one robot or docking station. Thus, the various features of the different embodiments may be mixed and matched in various cleaning apparatus configurations as desired to form new embodiments, whether or not the new embodiments are expressly described.

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular.

Likewise, it is also to be understood that the appended claims are not limited to express and particular components or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

What is claimed is:

1. An autonomous floor cleaning system comprising:

an autonomous floor cleaner comprising:

an autonomously moveable housing;

a drive system including at least one drive system motor operable to move the autonomously moveable housing about a floor surface; and a cleaning pad on an underside of the autonomously moveable housing; and a docking station comprising:

a base; and a platform configured to underlie the cleaning pad in a docked position of the autonomous floor cleaner at the docking station, the platform moveable upwardly in a direction away from the base and downwardly in a direction toward the base, wherein the platform comprises a lowered position for the autonomous floor cleaner to dock at the docking station and a raised position to engage the cleaning pad of the autonomous floor cleaner.

2. The autonomous floor cleaning system of claim 1, wherein the docking station comprises a controller configured to execute instructions to raise the platform away from the base after the autonomous floor cleaner is docked at the docking station.

3. The autonomous floor cleaning system of claim 1, wherein the autonomous floor cleaner comprises a pad driver supporting the cleaning pad, wherein the pad driver and the cleaning pad form a pad unit that is removeable from the housing at the docking station.

4. The autonomous floor cleaning system of claim 3, wherein the autonomous floor cleaner comprises a pad motor and a drive coupling configured to transmit rotational force provided by the pad motor to a drive shaft, wherein the pad driver comprises a magnetic coupling with the drive shaft to retain the pad unit.

5. The autonomous floor cleaning system of claim 1, wherein the docking station comprises:

a platform movement mechanism to raise and lower the platform relative to the base;

a platform motor operably coupled with the platform movement mechanism to provide driving input to raise and lower the platform; and wherein the platform movement mechanism comprises one of:

a four-bar linkage to raise and lower the platform relative to the base;

a cam-based lift mechanism to raise and lower the platform relative to the base; and a rack-and-pinion lift mechanism to raise and lower the platform relative to the base.

6. The autonomous floor cleaning system of claim 5, wherein the docking station comprises:

a platform lifter comprising a horizontally-translating ramp to raise and lower the platform relative to the base; and the platform motor is operably coupled with the platform lifter via the platform movement mechanism to provide driving input to raise and lower the platform.

7. The autonomous floor cleaning system of claim 1, wherein:

the autonomous floor cleaner comprises:

a supply tank configured to hold cleaning fluid;

a tank refill port; and a push rod configured to apply a force to release the cleaning pad from the housing; and the docking station comprises:

a refilling port configured to couple with the tank refill port; and a push rod actuator configured to engage the push rod to release the cleaning pad from the housing; and a downcomer assembly carrying the refilling port and the push rod actuator, the downcomer assembly configured to move downwardly to establish a fluid connection between the refilling port and the tank refill port and engage the push rod actuator with the push rod.

8. The autonomous floor cleaning system of claim 1, wherein the platform comprises scrubbers configured to engage the cleaning pad when the autonomous floor cleaner is docked at the docking station and the platform is raised.

9. The autonomous floor cleaning system of claim 1, wherein the autonomous floor cleaner is a wet cleaning robot and the cleaning pad comprises a mopping pad, and wherein the autonomous floor cleaner comprises a controller configured to execute instructions to clean the mopping pad when the docking station is docked at the docking station and the platform is raised away from the base.

10. A docking station for an autonomous floor cleaner, the docking station comprising:

a housing comprising a base;

at least one charging contact; and a platform moveable upwardly in a direction away from the base and downwardly in a direction toward the base, wherein the platform comprises a lowered position for the autonomous floor cleaner to dock at the docking station and a raised position to engage a cleaning pad on the autonomous floor cleaner.

11. The docking station of claim 10, comprising a controller configured to execute instructions to raise the platform away from the base after the autonomous floor cleaner is docked at the docking station.

12. The docking station of claim 10, comprising:

a platform movement mechanism to raise and lower the platform relative to the base;

a platform motor operably coupled with the platform movement mechanism to provide driving input to raise and lower the platform; and wherein the platform movement mechanism comprises one of:

a four-bar linkage to raise and lower the platform relative to the base;

a cam-based lift mechanism to raise and lower the platform relative to the base; and a rack-and-pinion lift mechanism to raise and lower the platform relative to the base.

13. The docking station of claim 12, comprising:

a platform lifter comprising a horizontally-translating ramp to raise and lower the platform relative to the base; and the platform motor is operably coupled with the platform lifter via the platform movement mechanism to provide driving input to raise and lower the platform.

14. The docking station of claim 10, comprising:

a refilling port configured to couple with the autonomous floor cleaner;

a push rod actuator configured to engage a push rod on the autonomous floor cleaner to release the cleaning pad from the autonomous floor cleaner; and a downcomer assembly carrying the refilling port and the push rod actuator, the downcomer assembly configured to move downwardly to establish a fluid connection between the refilling port and the autonomous floor cleaner and engage the push rod actuator with the push rod on the autonomous floor cleaner.

15. The docking station of claim 6, wherein the platform movement mechanism comprises a rack-and-pinion lift mechanism including a pinion gear that meshes with a rack gear coupled to the platform lifter.

16. The docking station of claim 1, comprising:

a platform movement mechanism to raise and lower the platform relative to the base;

a platform lifter coupled with the platform; and a platform motor operably coupled with the platform lifter via the platform movement mechanism to provide driving input to raise and lower the platform.

17. The docking station of claim 16, wherein the platform movement mechanism comprises a rack-and-pinion lift mechanism including a pinion gear that meshes with a rack gear coupled to the platform lifter.

18. The docking station of claim 13, wherein the platform movement mechanism comprises a rack-and-pinion lift mechanism including a pinion gear that meshes with a rack gear coupled to the platform lifter.

19. The docking station of claim 10, comprising:

a platform movement mechanism to raise and lower the platform relative to the base;

a platform lifter coupled with the platform; and a platform motor operably coupled with the platform lifter via the platform movement mechanism to provide driving input to raise and lower the platform.

20. The docking station of claim 19, wherein the platform movement mechanism comprises a rack-and-pinion lift mechanism including a pinion gear that meshes with a rack gear coupled to the platform lifter.

* * * * *